US007705867B2

(12) United States Patent
Nomura et al.

(10) Patent No.: US 7,705,867 B2
(45) Date of Patent: Apr. 27, 2010

(54) APPARATUS FOR FORMING LATENT IMAGE USING LINE HEAD AND CONTROL METHOD FOR SUCH APPARATUS

(75) Inventors: Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/418,412

(22) Filed: Apr. 3, 2009

(65) Prior Publication Data

US 2009/0190945 A1 Jul. 30, 2009

Related U.S. Application Data

(62) Division of application No. 11/445,998, filed on Jun. 2, 2006, now Pat. No. 7,564,473.

(30) Foreign Application Priority Data

Jun. 17, 2005 (JP) ..... 2005-177227
Jun. 20, 2005 (JP) ..... 2005-179146
Jun. 20, 2005 (JP) ..... 2005-179147
Jun. 23, 2005 (JP) ..... 2005-182876

(51) Int. Cl.
*B41J 2/435* (2006.01)
*B41J 2/47* (2006.01)

(52) U.S. Cl. ..... 347/234; 347/248

(58) Field of Classification Search ..... 347/224, 347/234–235, 248–250, 116, 229; 399/301
See application file for complete search history.

(56) References Cited

U.S. PATENT DOCUMENTS 5,634,171 A 5/1997 Muto ..... 399/32
6,049,690 A 4/2000 Nakayasu et al. ..... 399/301
6,070,041 A * 5/2000 Nakayasu et al. ..... 399/301
6,236,415 B1 5/2001 Nozaki et al. ..... 347/116
7,283,149 B2 10/2007 Nomura et al.
7,298,350 B2 * 11/2007 Kitazawa et al. ..... 345/76
2003/0020799 A1 1/2003 Koga et al.
2006/0146117 A1 * 7/2006 Kobayashi ..... 347/224

FOREIGN PATENT DOCUMENTS

JP 06-177431 6/1994
JP 10235930 A 9/1998
JP 2000284561 A 10/2000
JP 2003-019826 1/2003
JP 2003341140 A 12/2003
JP 2005041178 A 2/2005

* cited by examiner

*Primary Examiner*—Hai C Pham
(74) *Attorney, Agent, or Firm*—Hogan & Hartson LLP

(57) ABSTRACT

An apparatus includes: a latent image carrier which is freely rotatable in a predetermined sub scanning direction; a latent image carrier gear which is attached to an end portion of the latent image carrier; a drive motor which applies drive rotation force upon the latent image carrier via the latent image carrier gear and which rotates the latent image carrier; a line head which forms on the latent image carrier a line latent image which extends in a main scanning direction which is approximately orthogonal to the sub scanning direction; an exposure controller which provides an image signal to the line head and controls writing of the line latent image; a phase detector which detects the phase data regarding the latent image carrier gear; and a timing controller which adjusts the write location of the line latent image on the latent image carrier based on the phase data detected by the phase detector.

3 Claims, 18 Drawing Sheets

FIG. 1A : ARRANGEMENT OF PHASE DETECTING MARKS ON TRANSFER MEDIUM
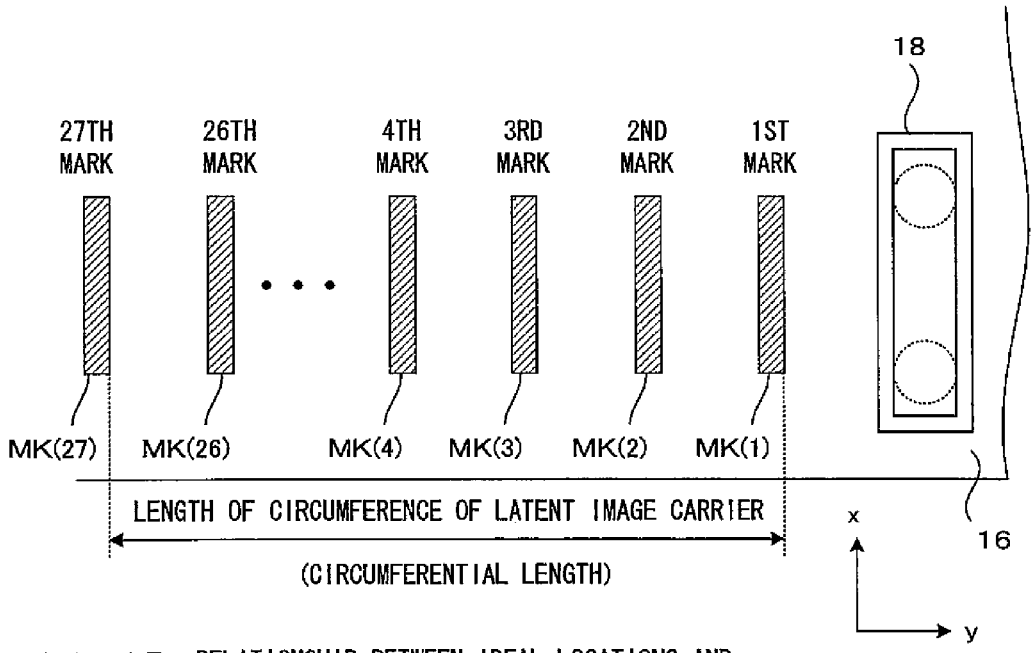
FIG. 1B : RELATIONSHIP BETWEEN IDEAL LOCATIONS AND ACTUALLY MEASURED LOCATIONS
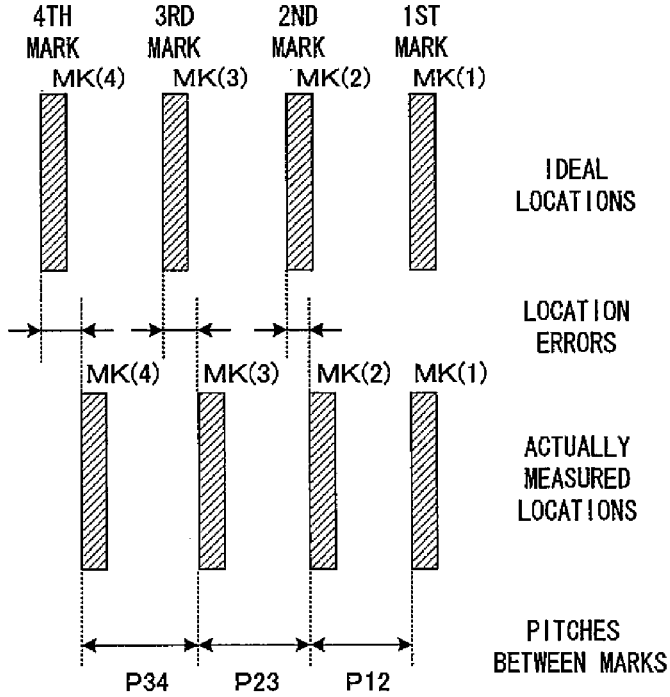

FIG. 11

| | | AMPLITUDE [μm] | | | |
|---|---|---|---|---|---|
| | | 0-10 | 10-20 | ・・・・・ | 40-50 |
| PHASE ANGLE [degree] | 0-30 | CORRECTED VALUE (0, 0) | CORRECTED VALUE (10, 0) | ・・・・・ | CORRECTED VALUE (40, 0) |
| | 30-60 | CORRECTED VALUE (0, 30) | CORRECTED VALUE (10, 30) | ・・・・・ | CORRECTED VALUE (40, 30) |
| | 60-90 | CORRECTED VALUE (0, 60) | CORRECTED VALUE (10, 60) | ・・・・・ | CORRECTED VALUE (40, 60) |
| | 90-120 | CORRECTED VALUE (0, 90) | CORRECTED VALUE (10, 90) | ・・・・・ | CORRECTED VALUE (40, 90) |
| | ・<br>・<br>・ | ・<br>・<br>・ | ・<br>・<br>・ | | ・<br>・<br>・ |
| | 330-360 | CORRECTED VALUE (0, 330) | CORRECTED VALUE (10, 330) | ・・・・・ | CORRECTED VALUE (40, 330) |

FIG. 12

CORRECTED VALUE (40, 210)

| NO. | INTERVALS OF Hsync [μs] |
|---|---|
| 1 | 353.47 |
| 2 | 353.47 |
| 3 | 353.48 |
| 4 | 353.48 |
| 5 | 353.48 |
| 6 | 353.49 |
| 7 | 353.49 |
| 8 | 353.49 |
| 9 | 353.50 |
| 10 | 353.50 |
| 11 | 353.50 |
| 12 | 353.51 |
| 13 | 353.51 |
| 14 | 353.51 |
| 15 | 353.52 |
| 16 | 353.52 |
| 17 | 353.52 |
| 18 | 353.53 |
| 19 | 353.53 |
| 20 | 353.53 |
| ・<br>・<br>・ | ・<br>・<br>・ |
| 1778 | 353.46 |
| 1779 | 353.46 |
| 1780 | 353.46 |

APPARATUS FOR FORMING LATENT IMAGE USING LINE HEAD AND CONTROL METHOD FOR SUCH APPARATUS

CROSS REFERENCE TO RELATED APPLICATION

This application is a divisional of application Ser. No. 11/455,998, filed on Jun. 2, 2006, which is incorporated herein by reference. The disclosure of Japanese Patent Applications enumerated below including specification, drawings and claims is incorporated herein by reference in its entirety:

No. 2005-177227 filed Jun. 17, 2005;

No. 2005-179146 filed Jun. 20, 2005;

No. 2005-179147 filed Jun. 20, 2005; and

No. 2005-182876 filed Jun. 23, 2005.

BACKGROUND

1. Technical Field

The present invention relates to an image forming apparatus which has a line head, and a control method for such an apparatus. The apparatus forms line latent images using the line head, develops the latent images with toner and accordingly forms an image.

2. Related Art

Known as an image forming apparatus which uses a line head in which light emitting elements such as light emitting diodes (LEDs) are arranged in rows is the image forming apparatus. The apparatus is described in JP-A-6-177431 for instance. In this apparatus, a latent image carrier such as a photosensitive member drum is driven into rotations in a sub scanning direction. A line head is disposed facing the photosensitive member drum. In this line head, plural light emitting elements are arranged in rows along a main scanning direction which is approximately orthogonal to the sub scanning direction. The elements turn on and off under control in response to an image signal. In consequence, a line latent image corresponding to the image signal is formed on the photosensitive member drum. In this manner, the light emitting elements are driven in response to an image signal covering one line while rotating the photosensitive member drum, whereby a line latent image is written. A two-dimensional latent image is thus formed on the photosensitive member drum. As the two-dimensional latent image is developed with toner, an image is formed.

Some use a line head which is comprised of multiple organic EL (electroluminescence) elements (See JP-A-2003-19826.). In such line heads, the multiple organic EL elements are arranged in rows (in a two-row staggered pattern) along the main scanning direction which is approximately orthogonal to the sub scanning direction. The elements turn on and off under control in response to an image signal. As a result, a line latent image corresponding to the image signal is formed on a photosensitive member drum.

SUMMARY

To drive a latent image carrier such as a photosensitive member drum, a latent image carrier gear is attached to an end portion of the latent image carrier. Drive rotation force from a motor is applied upon the latent image carrier via the latent image carrier gear, which makes the latent image carrier rotate in the sub scanning direction. Hence, the eccentricity of the latent image carrier gear could periodically change the rotation speed of the latent image carrier, and the periodic changes serve as one cause of a degraded image quality.

However, a conventional image forming apparatus does not sufficiently take the eccentricity of the latent image carrier gear into consideration, and there still is a room for improvement of an image quality.

According to one approach to drive a latent image carrier such as a photosensitive member drum, a latent image carrier gear is integrated with the latent image carrier and this integrated structure is attached to a main cartridge section to make a cartridge. This cartridge is attachable to and detachable from a main apparatus section. With the cartridge mounted, drive rotation force from a motor disposed to the main apparatus section is transmitted to the latent image carrier via the latent image carrier gear, and the latent image carrier rotates in the sub scanning direction. Hence, the eccentricity of the latent image carrier gear could periodically change the rotation speed of the latent image carrier, and the periodic changes serve as one cause of a degraded image quality However, conventional approaches have failed to establish a technique for accurately detecting the eccentricity-related characteristic of the latent image carrier gear.

A color image forming apparatus of the so-called tandem type is known as an apparatus which forms a color image. In such an image forming apparatus, multiple image forming stations which form toner images of mutually different colors are disposed along the direction in which a transfer medium such as an intermediate transfer belt moves. In each image forming station, a latent image carrier rotates owing to drive rotation force applied via a latent image carrier gear and a line head forms a line latent image on the latent image carrier in a similar fashion to that described above. Further, toner images formed on the respective latent image carriers are superimposed one atop the other on the transfer medium, whereby a color image is formed. In such an apparatus, the relationship between the respective latent image carriers in terms of the phase of rotations is adjusted, thereby suppressing periodic color misregistration and improving an image quality. By the way, in this apparatus, correction of color misregistration is performed on the premise that the eccentricity of the latent image carrier gears of the image forming stations is equal. Hence, if the latent image carrier gears are different from each other as for their eccentricity, it is not possible to obtain a sufficient effect, which in turn degrades an image quality. In addition, when each image forming station is to be fabricated as a cartridge, since its latent image carrier gear is linked directly to and integrated with a rotation shaft of its latent image carrier, there arises a problem that the phase adjustment above is impossible.

Further, the multiple exposure method is deployed in some line heads using organic EL elements. In such a line head, plural element rows in each one of which multiple organic EL elements are arranged along the main scanning direction are disposed along the sub scanning direction, which defines a structure of the so-called two-dimensional arrangement. After exposure of pixels on the latent image carrier with the organic EL elements in one line belonging to each row, the latent image carrier is moved. Furthermore, the organic EL elements in one line belonging to the next row are then positioned over and expose these pixels. It is therefore necessary to perform latent image forming processing (multiple exposure processing) while accurately positioning the element row relative to the latent image carrier. Hence, for image quality improvement, it is important to appropriately deal with the influence exerted by the eccentricity of the latent image carrier gears, namely, varying rotation speeds of the latent image carriers.

The invention is directed to an image forming apparatus, which forms latent images using a line head on a latent image carrier which rotate subjected to drive rotation force applied via a latent image carrier gear. An advantage of some aspects of the invention is to aim at suppressing the influence exerted by the eccentricity of the latent image carrier gear and improving an image quality in the apparatus.

An apparatus according to an aspect of the invention comprises: a latent image carrier which is freely rotatable in a predetermined sub scanning direction; a latent image carrier gear which is attached to an end portion of the latent image carrier; a drive motor which applies drive rotation force upon the latent image carrier via the latent image carrier gear and which rotates the latent image carrier; a line head which forms on the latent image carrier a line latent image which extends in a main scanning direction which is approximately orthogonal to the sub scanning direction; an exposure controller which provides an image signal to the line head and controls writing of the line latent image; a phase detector which detects the phase data regarding the latent image carrier gear; and a timing controller which adjusts the write location of the line latent image on the latent image carrier based on the phase data detected by the phase detector.

A method according to an aspect of the invention is of controlling an image forming apparatus. The method comprises: detecting the phase data of the latent image carrier gear; and adjusting the write location of the line latent image on the latent image carrier based on the detected phase data.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 1A and 1B are drawings which show the relationship between the actually measured locations of phase detecting marks and their ideal locations in the presence of the eccentricity of a latent image carrier gear;

FIG. 11 is a drawing which shows a correction table including correction data which are for periodic correction of the synchronization signal;

FIG. 12 is a drawing which shows one example of the correction data;

DESCRIPTION OF EXEMPLARY EMBODIMENTS

Figure 2:
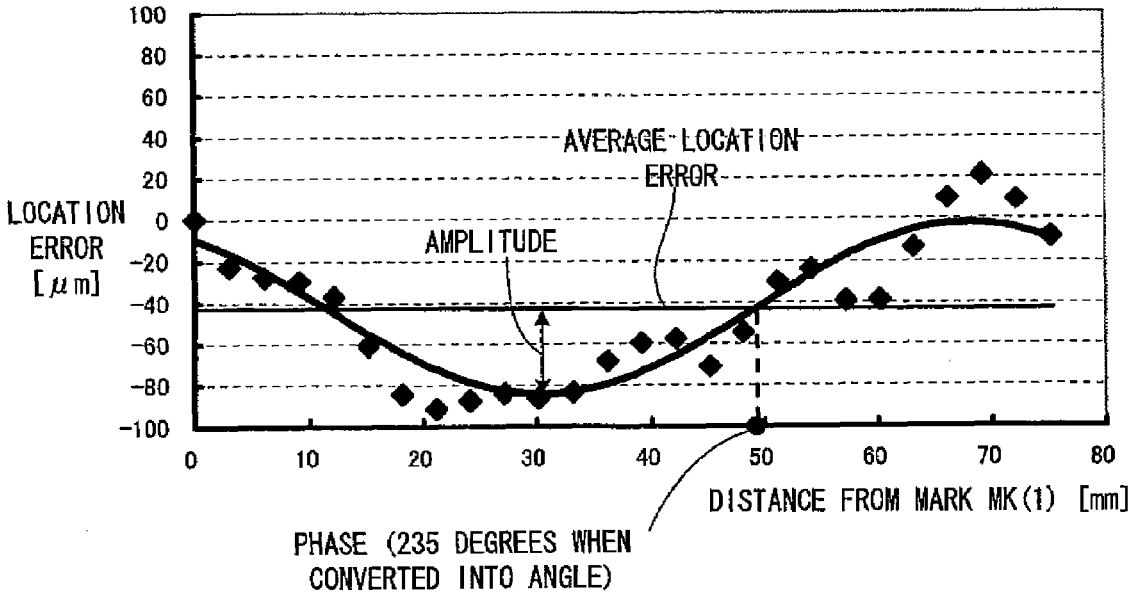
FIG. 2 is a graph which shows the location errors from the ideal locations of the phase detecting marks associated with the eccentricity of the latent image carrier gear.

In an attempt to drive latent image carriers such as photosensitive member drums, some image forming apparatuses use cartridges each one of which is obtained by fabricating a latent image carrier and a latent image carrier gear as one integrated structure and attaching this structure to a main cartridge section. In an apparatus having this structure, the eccentricity of the latent image carrier gears is influential. The inventor explored the influence exerted by the eccentricity of the latent image carrier gears and studied specific examples for suppressing the influence. After describing the consideration upon the influence of eccentric latent image carrier gears and countermeasures, embodiment of the invention will be described in the following.

A. Influence of Eccentric Latent Age Carrier Gears and Countermeasures

The influence exerted by the eccentricity of a latent image carrier gear manifests itself as the rotation speed of the associated latent image carrier. Describing in more specific details, the rotation speed periodically changes. As a result, the location of an actually formed image deviates from a preliminarily designed location, that is, an ideal location, which degrades an image quality. To shed light on this, an example of forming plural phase detecting marks at equal intervals all along the length of the circumference of the latent image carrier will be discussed.

FIGS. 1A and 1B are drawings which show the relationship between the actually measured locations of phase detecting marks and their ideal locations in the presence of the eccentricity of a latent image carrier gear. In the illustrated example, rectangular phase detecting marks each 7 mm wide along a main scanning direction x and 1 mm high along a sub scanning direction y are formed on a transfer medium 16 in accordance with a synchronization signal which is output in constant cycles (standard cycles). The medium 16 may be an intermediate transfer belt. The length of the circumference of the latent image carrier is about 78 mm, and therefore, there are 27 phase detecting marks MK(1), MK(2), . . . , MK(27) which are spaced apart 2 mm from each other along the sub scanning direction y. But for the eccentricity of the latent image carrier gear, the phase detecting marks MK(1), MK(2), . . . , MK(27) will be formed at so-called ideal locations and the neighboring marks will be equidistant to each other. In an actual apparatus, however, latent image carrier gears are inevitably eccentric, and the eccentricity could result in forming the phase detecting marks at locations which are off from the ideal locations by location errors as shown in FIG. 1B. Grasping changes of location errors as the intervals of the synchronization signal, this means that the intervals of the synchronization signal, namely, synchronization cycles change due to the eccentricity of the latent image carrier gear. These location errors can be detected by sensing the respective phase detecting marks MK(1), MK(2), . . . with a mark detection sensor 18 and analyzing a mark detection signal which is output from the sensor 18. The graph in FIG. 2 shows one example of the detection result.

Figure 3:
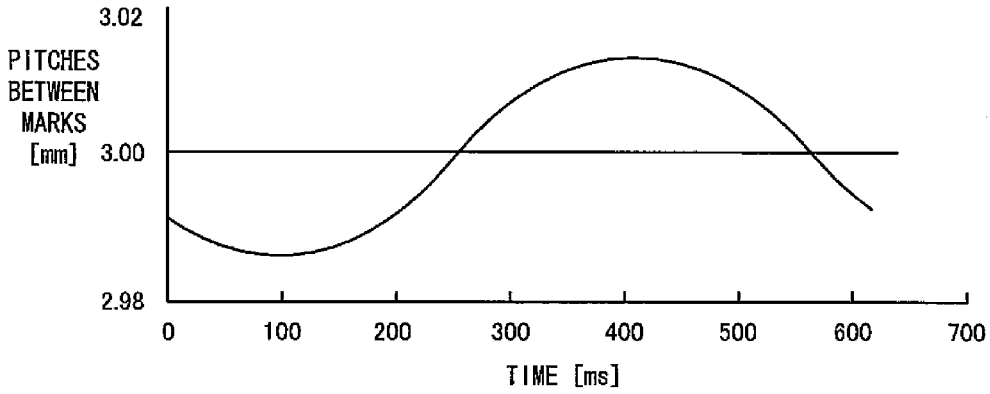
FIG. 3 is drawing which shows the pitch change associated with the eccentricity of the latent image carrier gear.

FIG. 2 is a graph which shows the location errors from the ideal locations of the phase detecting marks associated with the eccentricity of the latent image carrier gear. In FIG. 2, the ideal location of the first phase detecting mark MK(1) is made to coincide with the actually measured location, and the location errors (=the ideal locations−the actually measured locations) are calculated as for the other marks MK(2) through MK(27). The location errors of the marks MK(2) through MK(27) are plotted relative to the distance from the mark MK(1) on the transfer medium. As shown in FIG. 2, the eccentricity-related characteristic of the latent image carrier gear is specified by the amplitude and the phase. In short, according to the actual measurements shown in FIG. 2, the average location error is about −42 μm, the amplitude is about 40 μm, and the phase converted into an angle (phase angle) is about 235 degrees. The eccentricity-related characteristic of the latent image carrier gear is thus specified by the amplitude and the phase angle. Further detailed study of the eccentricity-related characteristic clarifies the following based on the eccentricity-related characteristic shown in FIG. 2. That is, in a region where the distance from the mark MK(1) is short (distance: 0-20 mm), the location errors gradually grows, and as shown in FIG. 1B, the pitches P12, P23, P34, . . . between the marks are progressively wide. In the next region (distance: 20-40 mm), the location errors change less. Near the location at the maximum amplitude (distance: approximately 30 mm), the mark pitch is a standard pitch, and before and after this location, deviations from the standard pitch are small. This remains similar in the further region as well. This then apparently follows that conversion of the eccentricity-related characteristic shown in FIG. 2 into a pitch characteristic clarifies the relationship between the locations of the neighboring marks. In other words, differentiation of the eccentricity-related characteristic shown in FIG. 2 identifies the pitch characteristic (which is denoted at the curve in FIG. 3). The linear line in FIG. 3 is indicative of the standard pitch.

Figure 4:
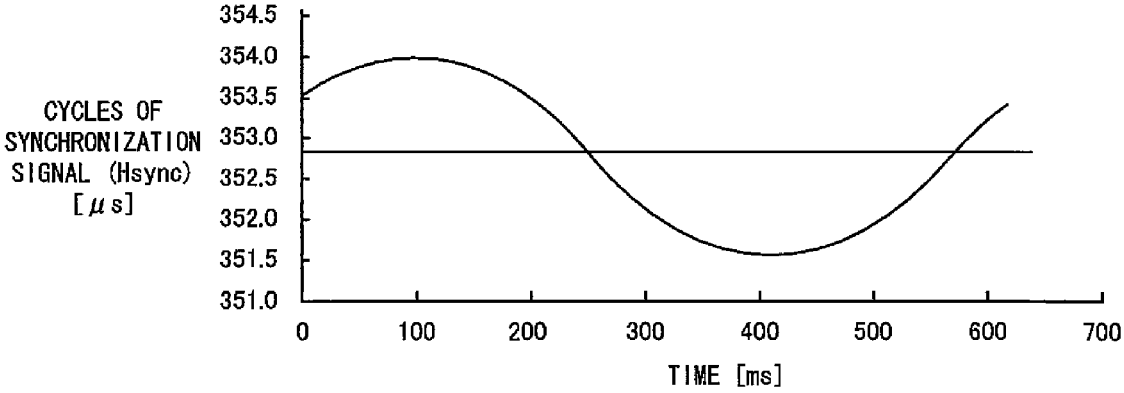
FIG. 4 is drawing which shows the cycle of the synchronization signal which is suited to suppress the eccentricity of the latent image carrier gear.
Figure 5:
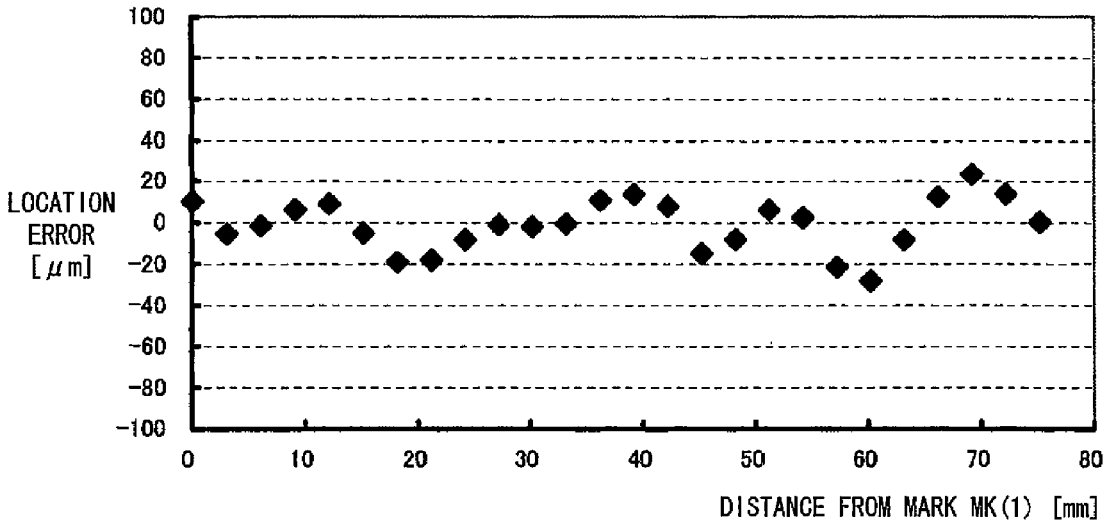
FIG. 5 is a graph which shows the location errors from the ideal locations of the phase detecting marks formed in synchronization to the synchronization signal shown in FIG. 4.

Noting that the pitches between the marks MK(1), MK(2), . . . are different because of the eccentricity of the latent image carrier gear, the inventor of the invention has conceived suitable control to such changes. In short, the inventor of the invention has arrived at findings that control of the cycle of the synchronization signals along the opposite direction to such changes would cancel out the eccentricity of the latent image carrier gear and suppress the location errors. Describing in more specific details, the inventor of the invention changed the cycles of the synchronization signal utilizing a characteristic (which is denoted at the curve in FIG. 4) which was obtained by reversing the pitch characteristic. While changing the cycles of the synchronization signal using the characteristic denoted at the curve in FIG. 4, the inventor of the invention formed the phase detecting marks MK(1) through MK(27) and calculated location errors. As a result, the location errors were significantly suppressed as shown in FIG. 5.

The invention therefore requires detecting phase data (the amplitude and the phase angle) indicative of the eccentricity-related characteristic of a latent image carrier gear, correcting the cycles of synchronization signal based on the phase data and adjusting the write location of the latent image on a latent image carrier, to thereby improve an image quality. The invention will now be described in further details in relation to particular embodiments.

B. First Embodiment

Figure 6:
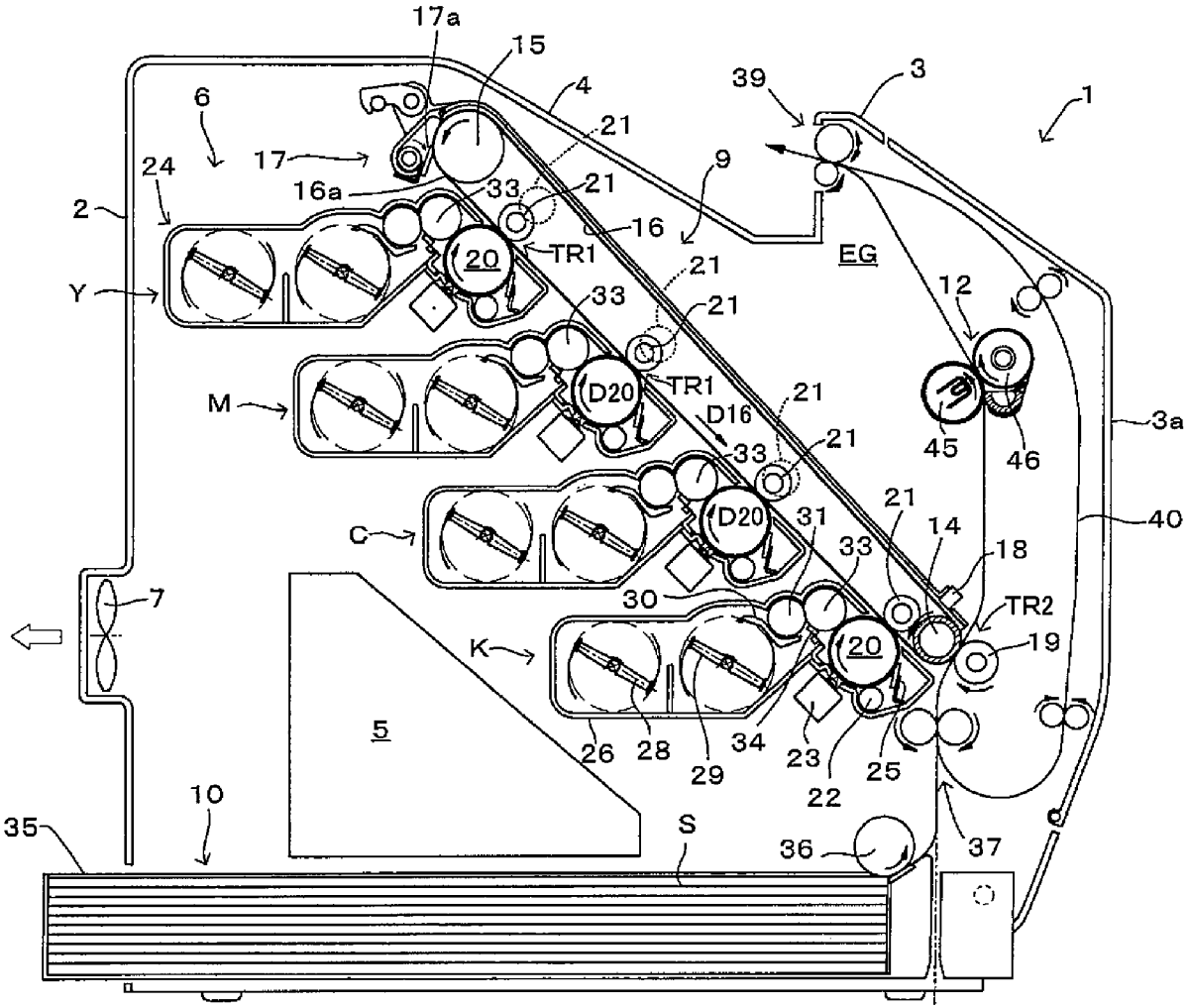
FIG. 6 is a drawing which shows a first embodiment of the image forming apparatus according to the invention.

FIG. 6 is a drawing which shows a first embodiment of the image forming apparatus according to the invention. This apparatus 1 selectively executes either color printing or monochromatic printing. In the color printing, the apparatus 1 superimposes toner (developers) of four colors, i.e., black (K), cyan (C), magenta (M) and yellow (Y) one atop the other and accordingly forming a full-color image. While, in the monochromatic printing, the apparatus 1 forms a monochrome image using only black (K) toner. In the image forming apparatus 1, a main controller (not shown) receives an image forming command (print command) from an external apparatus such as a host computer. In response to the command, an engine controller (not shown) control respective portions of an engine section EG, whereby a predetermined image forming operation is performed and an image corresponding to the image forming command is formed on a sheet (recording material) S such as a copy paper, a transfer paper, a general paper and a transparent sheet for an overhead projector.

In FIG. 6, the image forming apparatus 1 according to this embodiment comprises a main housing (main apparatus section) 2, a first open/close member 3 and a second open/close member (which serves also as a paper discharge tray) 4. The first open/close member 3 is attached to the front face (the right-hand side surface) of the main housing 2 in such a manner that the first open/close member 3 can freely open and close. In the first open/close member 3, an open/close lid 3*a* is attached to the front face of the main housing 2 in such a manner that the open/close lid 3*a* can freely open and close. The open/close lid 3*a* is capable of opening and closing in a concerted operation with the first open/close member 3 or independently of the first open/close member 3. The second open/close member 4 is attached to the top surface of the main housing 2 in such a manner that the second open/close member 4 can freely open and close.

An electrical equipment box 5 internally comprising a power circuit board, the main controller and the engine controller is disposed within the main housing 2. An image forming unit 6, a transfer belt unit 9 and a paper feed unit 10 as well are disposed inside the main housing 2. A fixing unit 12 is disposed closer to the first open/close member 3. In this embodiment, consumables inside the image forming unit 6 and the paper feed unit 10 are freely attachable to and detachable from the main housing 2. This structure allows detaching these consumables and the transfer belt unit 9 to repair or replace them.

The transfer belt unit 9 comprises a drive roller 14, a follower roller 15, an intermediate transfer belt 16 and a belt cleaner 17. The drive roller 14 is disposed below the main housing 2. The follower roller 15 is disposed at an upper diagonal position relative to the drive roller 14. The intermediate transfer belt 16 spans between these two rollers 14 and 15 and rotates when driven along the arrow direction D16 shown in FIG. 6. The belt cleaner 17 abuts on the surface of the intermediate transfer belt 16. The follower roller 15 is disposed at an upper diagonal position relative to the drive roller 14 (upper left-hand side in FIG. 6). Hence, the intermediate transfer belt 16 rotates as it is inclined along the direction D16. Further, a belt surface 16*a* of the driven intermediate transfer belt 16 along the downward section of the belt transporting direction D16 (toward the lower right-hand side in FIG. 6) is faced down. In this embodiment, the belt surface 16*a* is a tension belt surface (the surface which is pulled by the drive roller 14) while the belt is in motion, and rotates at a slower circumferential speed than that of photosensitive member drums (image carriers) 20 for the respective colors. With the circumferential speed of the intermediate transfer belt 16 set slower than that of the photosensitive member drums 20, the photosensitive member drums 20 are driven as if they were pulled by the intermediate transfer belt 16 in a direction which suppresses rotations.

The drive roller 14 serves also as a backup roller for a secondary transfer roller 19. The drive roller 14 on its circumferential surface seats a rubber layer which has the thickness of approximately 3 mm and the volume resistance of 100 kΩ·cm or less. Grounded via a metal shaft, the drive roller 14 functions as a conduction path for a secondary transfer bias which is supplied via the secondary transfer roller 19 from a secondary bias generator not shown. The existence of the rubber layer which is highly abrasive and absorbs an impact on the drive roller 14 discourages transmission of an impact associated by arrival of a sheet S to a secondary transfer part to the intermediate transfer belt 16 and accordingly prevents deterioration of an image.

Further, in this embodiment, the diameter of the drive roller 14 is smaller than that of the follower roller 15. This makes it easy to strip the sheet S after secondary transfer, utilizing the flexibility of the sheet S itself. In addition, the follower roller 15 serves also as a backup roller for the belt cleaner 17. The belt cleaner 17 is disposed closer to the belt surface 16*a* which is faced down along the downward section of the transporting direction, and comprises a cleaning blade 17*a* which removes residual toner and a toner transporting member which transports removed toner as shown in FIG. 6. The cleaning blade 17*a* abuts on the intermediate transfer belt 16 at a section where the intermediate transfer belt 16 is wound around the follower roller 15. The blade 17*a* removes toner which still remains on the surface of the intermediate transfer belt 16 even after secondary transfer. Accordingly, the intermediate transfer belt 16 is cleaned up.

The drive roller 14 and the follower roller 15 are supported by a support frame (not shown) of the transfer belt unit 9 so that they can freely rotate. Further, the apparatus 1 comprises primary transfer rollers 21 which are opposed against the photosensitive member drums 20 of the image forming stations Y, M, C and K which will be later. Each of the rollers 21 is disposed to the back of the belt surface 16*a* which is along the downward section of the transporting direction. The support frame mentioned above axially supports these four primary transfer rollers 21 for free rotations. The primary transfer rollers 21 are electrically connected with a primary transfer bias generator not shown which applies a primary transfer bias upon the primary transfer rollers 21 at proper timing.

The support frame mentioned above is capable of freely swinging around the drive roller 14 relative to the main housing 2. As an actuator not shown operates to swing the support frame, the primary transfer rollers 21 of the image forming stations Y, M and C for yellow (Y), magenta (M) and cyan (C) move closer to or away from the photosensitive member drums 20. Moving closer to the photosensitive member drums 20, the primary transfer rollers 21 for yellow, magenta and cyan abut on the photosensitive member drums 20 through the intermediate transfer belt 16 (as denoted at the solid lines in FIG. 6). These abutting positions are primary transfer positions at which toner images are transferred onto the intermediate transfer belt 16. On the contrary, when the primary transfer rollers 21 for yellow, magenta and cyan move away from the photosensitive member drums 20, the photosensitive member drums 20 of the image forming stations Y, M and C get spaced apart from the intermediate transfer belt 16 (as denoted at the dashed lines in FIG. 6). Meanwhile, the primary transfer roller 21 disposed facing the photosensitive member drum 20 of the image forming station for black (K) rotates while abutting on the photosensitive member drum 20 via the intermediate transfer belt 16. Hence, as denoted at the solid lines in FIG. 6, with all primary transfer rollers 21 moved onto the photosensitive member drums 20, color printing becomes possible. When the other primary transfer rollers 21 leave the associated photosensitive member drums 20 except for the black primary transfer roller 21, it is possible to perform the monochromatic printing alone. In the monochromatic printing, the intermediate transfer belt 16 is off from the image forming stations Y, M and C, to perform no printing in the yellow, the magenta and the cyan colors. If necessary, the black primary transfer roller 21 may move away from the associated photosensitive member drum 20.

The support frame of the transfer belt unit 9 also bears the mark detection sensor 18 which is located in the vicinity of the drive roller 14. The mark detection sensor 18 is a sensor which aligns the locations of toner images on the intermediate transfer belt 16, detects the densities of the toner images and corrects color misregistration, the image density or the like of each color image. For calculation of phase data regarding the latent image carrier gears such as photosensitive member gears in the manner described later, the sensor 18 detects phase detecting marks which are formed on the intermediate transfer belt (transfer medium) 16.

Figure 7:
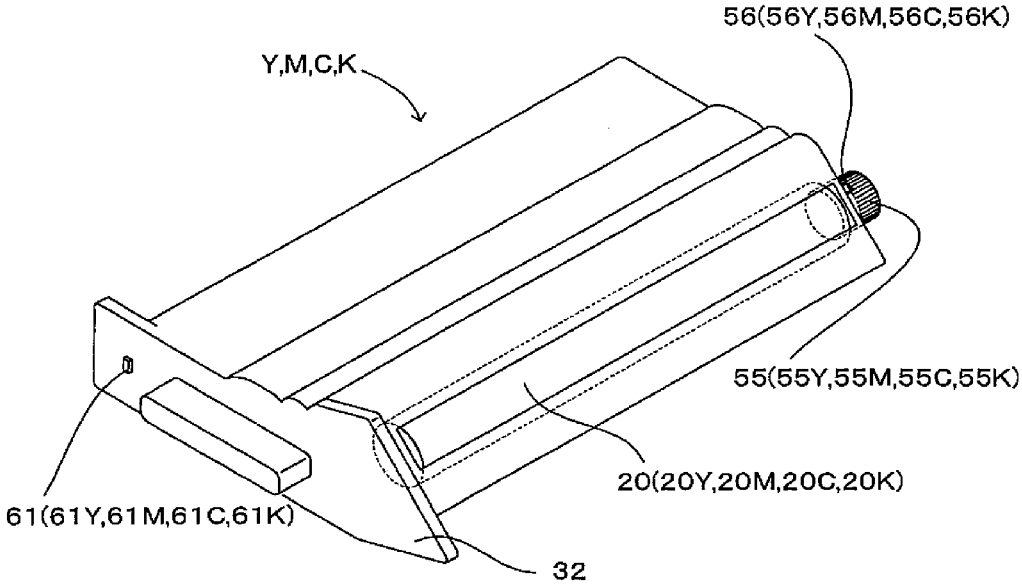
FIG. 7 is a perspective illustration of the image forming station which is mounted to the apparatus shown in FIG. 6.

The image forming unit 6 comprises the image forming stations Y (yellow), M (magenta), C (cyan) and K (black) which form images in plural different colors (four colors in this embodiment). The respective image forming stations Y, M, C and K comprise the photosensitive member drums 20 which correspond to the "latent image carrier" of the invention. Further, a charger 22, an image writer 23, a developer 24 and a photosensitive member cleaner 25 are disposed around each photosensitive member drum 20. These functional parts execute a charging operation, a latent image forming operation and a toner developing operation. In FIG. 6, the respective image forming stations of the image forming unit 6 have the same structure, and therefore, for the convenience of illustration, reference symbols are assigned to some image forming stations but are not assigned to the other image forming stations. The order in which the image forming stations Y, M, C and K are arranged may be any desired order. Further, in this embodiment, as shown in FIG. 7, in each one of the respective image forming stations Y, M, C and K, the structure parts described above are attached to a cartridge body 32, thereby defining a cartridge as for each one of the stations X, M, C and K. Each cartridge is freely attachable to and detachable from the main housing 2.

As the respective image forming stations X, M, C and K are mounted to the main housing 2, the photosensitive member drums 20 become abutting on the belt surface 16*a* which is along the downward section of the transporting direction at the primary transfer positions TR1. As a result, the respective image forming stations Y, M, C and K as well get inclined toward the left-hand side in FIG. 6 relative to the drive roller 14.

The chargers 22 comprise charging rollers whose surfaces are made of elastic rubber. The charging rollers are structured so as to abut on the surfaces of the photosensitive member drums 20 at charging positions and rotate following the surfaces of the photosensitive member drums 20. As the photosensitive member drums 20 rotate, the charging rollers rotate following the photosensitive member drums 20 at the circumferential speed in the direction which follows the photosensitive member drums 20. Further, the charging rollers are connected with a charging bias generator (not shown), and fed with a charging bias from the charging bias generator. Therefore, the charging rollers charge up the surfaces of the photosensitive member drums 20 at the charging positions.

The image writers 23 use line heads each of which has light emitting elements, such as light emitting diodes and liquid crystal shutters comprising back lights. The light emitting elements are arranged in rows along the axial direction of the photosensitive member drums 20 (i.e., along the direction perpendicular to the plane of FIG. 6). The image writers 23 are disposed so that the line heads are spaced apart from the photosensitive member drums 20. The line heads have shorter optical lengths than that of a laser scanning optical system, and are accordingly compact. This permits disposing the line heads in the proximity of the photosensitive member drums 20, which provides a benefit of reducing the total size of the apparatus as a whole. The structure and drive control of the line heads will be described in detail later.

The details of the developers 24 will now be described, in relation to the image forming station K as a typical example. The developers 24 each comprise a toner container 26, two toner stirring/supplying members 28 and 29, a toner supply roller 31 and a regulator blade 34. The toner container 26 holds toner. The two toner stirring/supplying members 28 and 29 are disposed inside the toner container 26. The partition member 30 is disposed in the vicinity of the toner stirring/supplying member 29. The toner supply roller 31 is disposed above the partition member 30. The developer roller 33 abuts on the toner supply roller 31 and the associated photosensitive member drum 20 and rotates at a predetermined circumferential speed along the direction denoted at the arrow. The regulator blade 34 abuts on the developer roller 33.

In each developer 24, toner stirred and lifted up by the toner stirring/supplying member 29 is fed to the toner supply roller 31 along the top surface of the partition member 30. Thus fed toner reaches the surface of the developer roller 33 via the toner supply roller 31. The regulator blade 34 restricts the toner supplied to the developer roller 33 into a layer having a predetermined thickness, and the toner is transported as such to the photosensitive member drum 20.

The developer roller 33 is electrically connected with a developer bias generator (not shown) and applied a developer bias upon. On applying the developer bias, charged toner moves to the photosensitive member drum 20 from the developer roller 33 at a developing position where the developer roller 33 and the photosensitive member drum 20 abut on each other. It is possible to visualize an electrostatic latent image formed by the image writer 23.

Further, in this embodiment, the photosensitive member cleaners 25 is disposed on the downstream side to the primary transfer positions TR1 along the direction D20 in such manner that the cleaners 25 abuts on the surfaces of the photosensitive member drums 20. The direction D20 is a direction in which the photosensitive member drums 20 rotate. Abutting on the surfaces of the photosensitive member drums 20, the photosensitive member cleaners 25 remove residual toner on the surfaces of the photosensitive member drums 20 after primary transfer and clean the surfaces.

The paper feed unit 10 comprises a paper feeder which is formed by a paper feeding cassette 35 in which sheets S are held in a stack and a pick-up roller 36 which sends the sheets S one by one from the paper feeding cassette 35. Disposed within the first open/close member 3 are paired registration rollers 37, the secondary transfer roller 19, the fixing unit 12, paired paper discharger rollers 39 and a double-sided print transportation path 40. The registration rollers 37 define the timing of feeding a sheet S to a secondary transfer region TR2. The secondary transfer roller 19 is urged as a secondary transfer element against the drive roller 14 and the intermediate transfer belt 16.

The secondary transfer roller 19 is disposed so that it can freely abut on and leave the intermediate transfer belt 16, and is driven by a secondary transfer roller drive mechanism (not shown) to abut on and leave. The fixing unit 12 comprises a heater roller 45 which incorporates a heater such as a halogen heater and rotates freely and a pressure roller 46 which urges and presses the heater roller 45. An image secondarily transferred onto a sheet S is fixed on the sheet S at a predetermined temperature in a nip portion which is defined by the heater roller 45 and the pressure roller 46. In this embodiment, the space created diagonally above the intermediate transfer belt 16, that is, the space which is on the opposite side to the image forming unit 6 across the intermediate transfer belt 16 can house the fixing unit 12. This arrangement makes it possible to reduce thermal conduction to the electrical equipment box 5, the image forming unit 6 and the intermediate transfer belt 16, and hence, decrease the frequency of correcting color misregistration for each color.

The sheet S subjected to fixing is transported to the second open/close member (paper discharge tray) 4 which is disposed to the top surface portion of the main housing 2 via the paired paper discharger rollers 39. Where it is necessary to form images on the both sides of a sheet S, the paired paper discharger rollers 39 rotate in the reverse direction upon arrival of the rear end of the sheet on whose one surface an image has been formed in the manner above at the reversing position behind the paired paper discharger rollers 39. This reverse operation transports the sheet S back along the double-sided print transportation path 40. The sheet S returns back again to the transportation path before the paired registration rollers 37. At this stage the surface of the sheet S on which an image is formed while abutting on the intermediate transfer belt 16 in the secondary transfer region TR2 is the opposite surface to the surface on which an image has already been formed. In this fashion, images are formed on the both surfaces of the sheet S.

Figure 8:
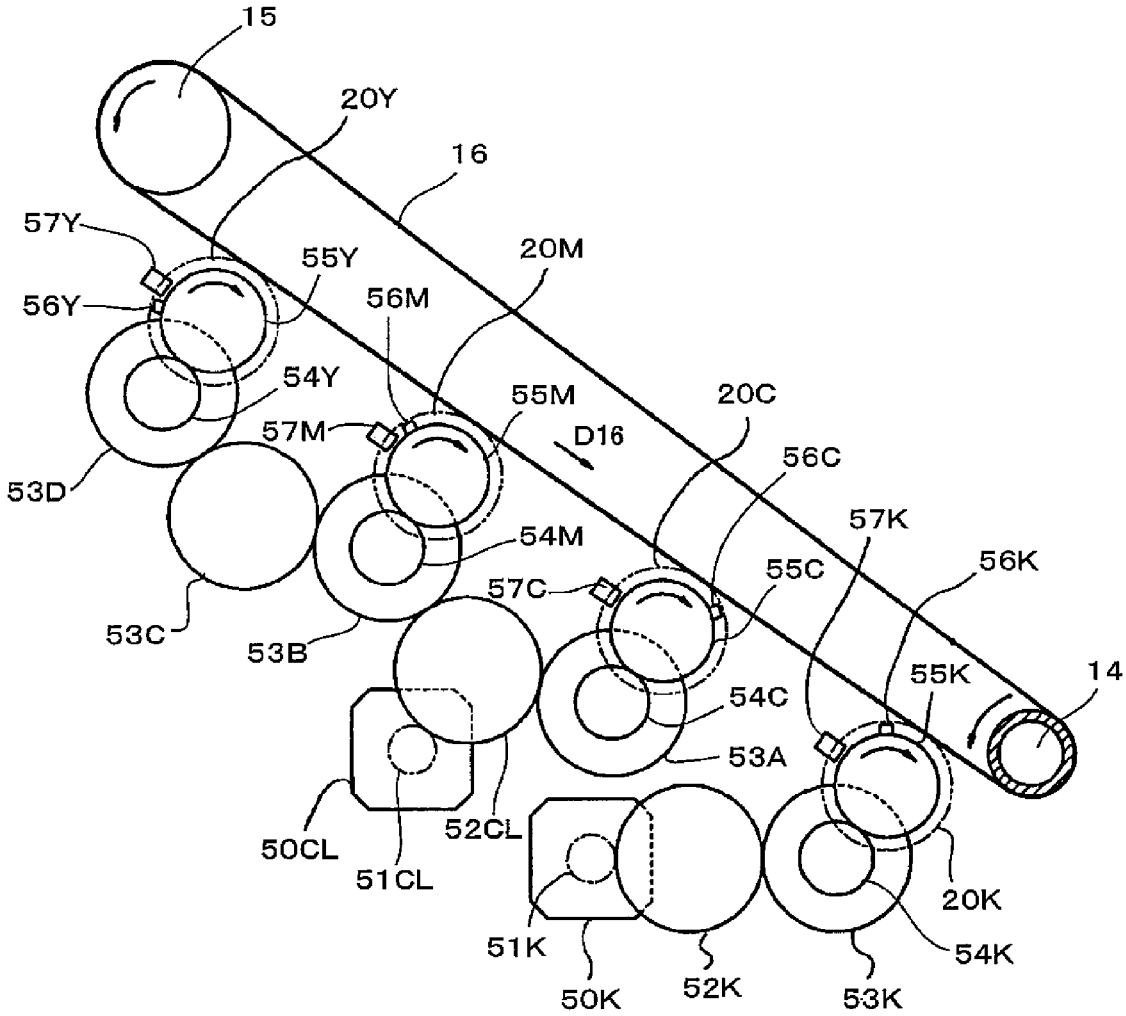
FIG. 8 is a schematic diagram which shows the relationship between the location of the intermediate transfer belt and those of the photosensitive member drums for the respective colors.

FIG. 8 is a schematic diagram which shows the relationship between the location of the intermediate transfer belt and those of the photosensitive member drums for the respective colors. While the image forming apparatus 1 according to this embodiment is equipped with the photosensitive member drums 20 for the four colors, there are only two drive motors 50K and 50CL. The drive motor 50K drives the black photosensitive member drum 20K into rotations. A motor pinion 51K is attached to the rotation shaft of the drive motor 50K, and an idler gear 52K engages with the motor pinion 51K. Further, another idler gear 53K engages with the idler gear 52K. An idler gear 54K is attached coaxially to the idler gear 53K so that the drive rotation force of the drive motor 50K is transmitted to the idler gear 53K via the motor pinion 51K and the idler gear 52K. Hence, in response to operation of the drive motor 50K, the idler gears 53K and 54K rotate as one unit. The motor 50K, the motor pinion 51K and the idler gears 52K through 54K are fixedly disposed to the main housing 2. Meanwhile, a photosensitive member gear 55K is capable of moving together with the black image forming station K. That is, in the black image forming station K, the photosensitive member gear 55K is attached at the end of the black photosensitive member drum 20K in such a manner that the photosensitive member gear 55K is coaxial with a rotation shaft of the black photosensitive member drum 20K as shown in FIGS. 7 and 8. As the black image forming station K is mounted to the main housing 2, the photosensitive member gear 55K engages with the idler gear 54K. Due to this, control of the drive motor 50K exposes the black photosensitive member drum 20K to the drive rotation force developing at the motor 50K, whereby the black photosensitive member drum 20K rotates along the sub scanning direction D20.

Other drive motor 50CL drives the photosensitive member drums 20Y, 20M and 20C for yellow, magenta and cyan into rotations. The drive motor 50CL bears a motor pinion 51CL with which an idler gear 52CL engages. An idler gear 53A engages with the idler gear 52CL on the black side (i.e., the bottom right-hand side in FIG. 8) relative to the idler gear 52CL. An idler gear 53B engages with the idler gear 52CL on the magenta side (i.e., the upper left-hand side in FIG. 8). To the idler gear 53A, an idler gear 54C is attached coaxially. An idler gear 54M is attached coaxially to another idler gear 53B, and an idler gear 53C engages with the idler gear 53B on the yellow side (i.e., the upper left-hand side in FIG. 8). Further, yet another idler gear 53D engages with this idler gear 53C. An idler gear 54Y is attached coaxially to the idler gear 53D. The combination of the multiple gears form a string of rings, which transmits the drive rotation force from the drive motor 50CL to the respective idler gears 54Y, 54M and 54C simultaneously. The drive motor 50CL, the motor pinion 51CL and the associated gear group are also fixedly disposed to the main housing 2, which is similar to the black side. In addition, photosensitive member gears 55Y, 55M and 55C for yellow, magenta and cyan, just like on the black side, are capable of moving together with the image forming stations Y, M and C. In this embodiment, the photosensitive member gears 55Y, 55M, 55C and 55K are directly linked respectively to the photosensitive member drums (latent image carriers) 20Y, 20M, 20C and 20K and correspond to the "latent image carrier gear" of the invention. Further, as described above, the structures which are integration of the photosensitive member drums and the photosensitive member gears are attached to the cartridge bodies 32, thereby forming the cartridges.

In addition, in this embodiment, the photosensitive member gears 55 directly linked with the rotation shafts of the photosensitive member drums 20 have smaller diameters than those of the photosensitive member drums 20 (20Y, 20M, 20C and 20K). Furthermore, phase detecting projections 56 protrude as phase references from the outer circumferential portions of the photosensitive member gears 55. As the image forming stations (Y, M, C and K) are mounted to the main housing 2 in the manner described above, phase sensors 57 (57Y, 57M, 57C and 57K) fixed to the main housing 2 become capable of detecting the phase detecting projections 56. In this embodiment, the phase detecting projections 56 thus function as the "phase detecting reference" of the invention. However, the phase detecting reference is not limited to a protruding shape. For instance, the photosensitive member gears 55 may include local concave sections for instance so that the concave sections function as the phase detecting references.

Each phase sensor 57 comprises a light projector and a light receiver. The light projector irradiates light toward the rotation track of the associated phase detecting projection 56 of the associated photosensitive member gear 55. The light receiver receives light reflected by the phase detecting projection 56 and outputs a signal which corresponds to the amount of the received light. Hence, every time the phase detecting projection 56 disposed to the photosensitive member gear 55 moves passed the phase sensor 57, a pulse signal is output to a phase measuring section which is disposed to the engine controller which will be described below.

Figure 9:
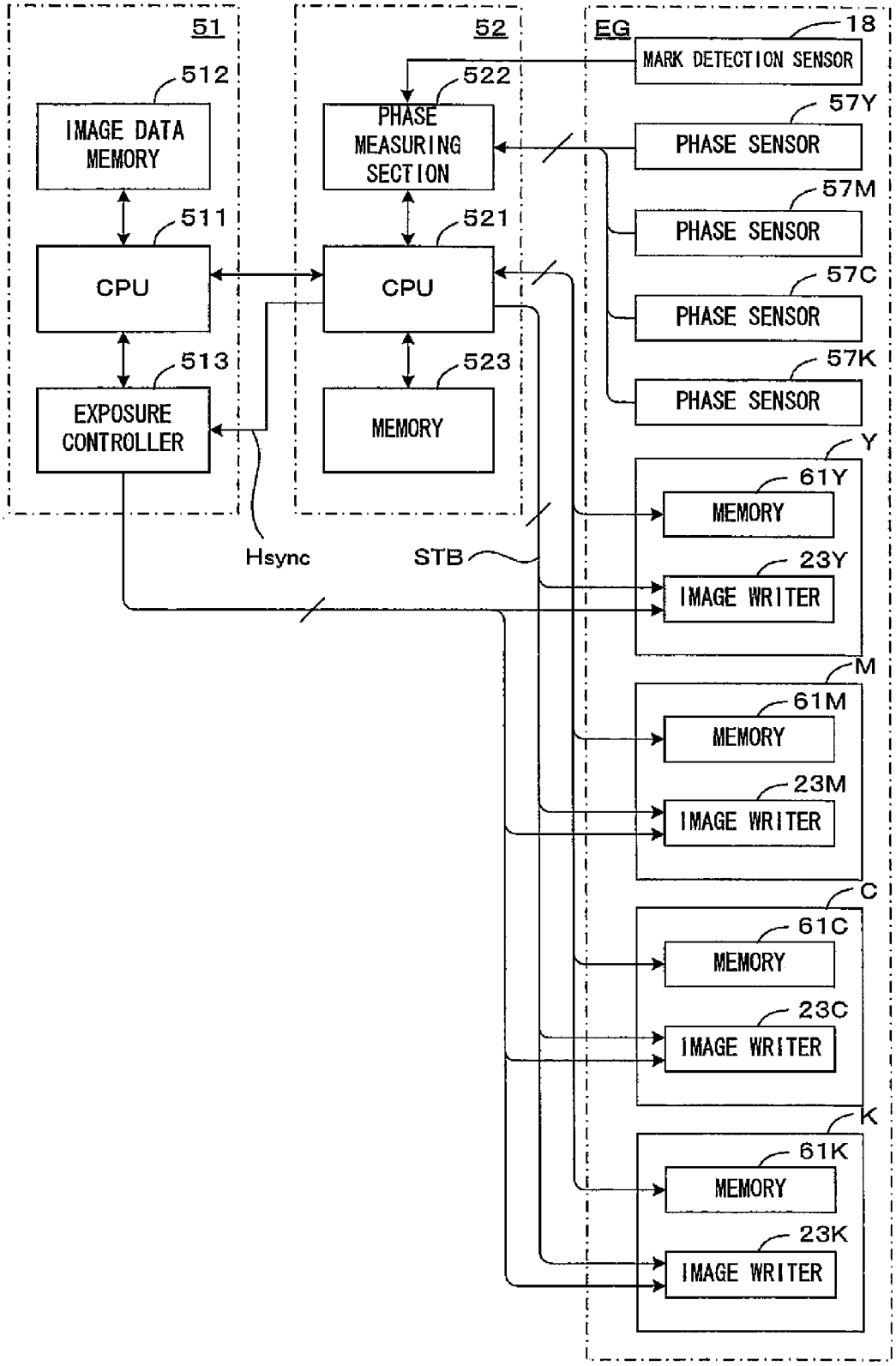
FIG. 9 is a block diagram which shows a principal electric structure of the image forming apparatus shown in FIG. 6.

FIG. 9 is a block diagram which shows a principal electric structure of the image forming apparatus shown in FIG. 6. This apparatus 1 is equipped with a main controller 51 and an engine controller 52. The main controller 51 comprises a CPU 511, an image data memory 512 and an exposure controller 513. When receiving an image forming command (print command) from an external apparatus such as a host computer, the CPU 511 of the main controller 51 provides the engine controller 52 with a control signal which corresponds to the image forming command. The image data memory 512 temporarily stores image data contained in the image forming command. The exposure controller 513 receives a synchronization signal Hsync whose cycles are corrected as described later, and provides the image writers 23 with an image signal VSG at such timing which corresponds to the synchronization signal Hsync.

Figure 10:
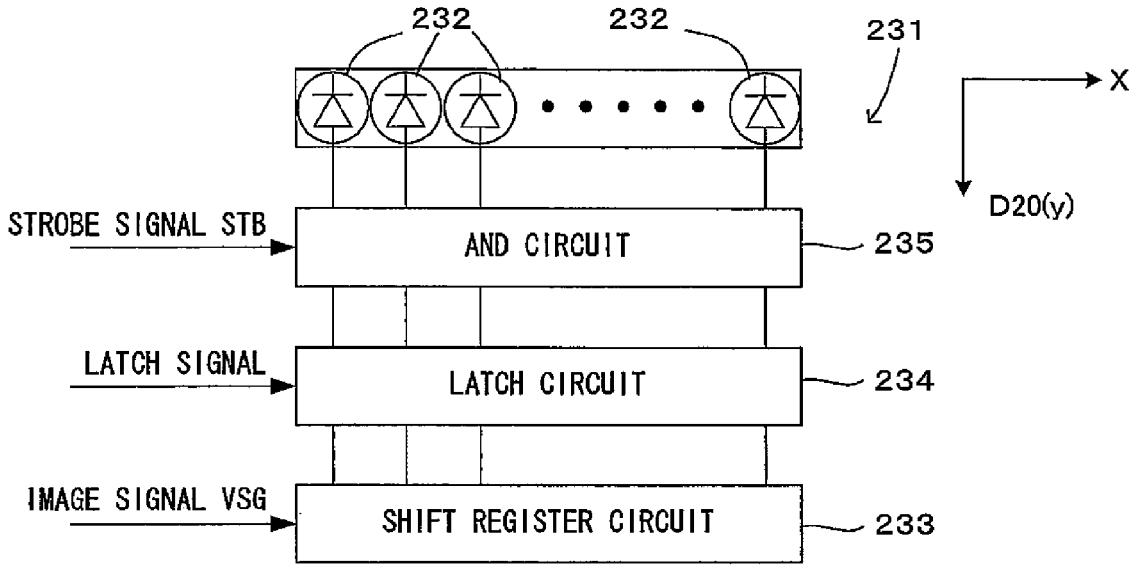
FIG. 10 is a drawing which shows a structure of a line head.

Meanwhile, the engine controller 52 comprises a CPU 521, the phase measuring section 522 and a memory 523. Of these elements, the CPU 521 controls the respective portions of the engine section EG in response to the command from the CPU 511 of the main controller 51 and executes a predetermined image forming operation. As apart of this operation, the CPU 521 outputs a strobe signal STB to each image writer 23 at proper timing and makes the light emitting elements forming the associated line head emit light. The plural light emitting elements are thus driven almost simultaneously, whereby a line latent image is written on the associated photosensitive member drum 20. In other words, in the line head 231 of each image writer 23, as shown in FIG. 10, the multiple light emitting elements 232 are arranged in rows along the direction D20 (FIG. 6) in which the associated photosensitive member drum 20 rotates, i.e., along the main scanning direction X approximately orthogonal to the sub scanning direction. Further, the line head 231 comprises a shift register circuit 233, a latch circuit 234 and an AND circuit 235. The shift register circuit 233 receives from the exposure controller 513 the image signal VSG covering one line in response to a clock signal (not shown). The latch circuit 234 acquires the image signal VSG from the shift register circuit 233, in accordance with a latch signal. Receiving the strobe signal STB from the CPU 521, the AND circuit 235 outputs the image signal VSG to the light emitting elements 232. Hence, the light emitting elements 232 responsive to the image signal VSG emit light at the same time, thereby forming a line latent image corresponding to the image signal VSG which represents one line on the associated photosensitive member drum 20. This embodiment, requiring control of the timing of outputting the image signal VSG from the exposure controller 513 or the timing of outputting the strobe signal STB from the CPU 521, permits control of the timing of writing a line latent image. In this embodiment, the CPU 521 thus functions as the "timing controller" of the invention.

This will be continuously described with reference back to FIG. 9 again. The CPU 521 is electrically connected further with non-volatile memories 61Y, 61M, 61C and 61K which are disposed to the image forming stations Y, M, C and K. That is, as shown in FIG. 7, each one of the memories 61Y, 61M, 61C and 61K is fixed to a side surface portion of the associated cartridge body 32, and stores information regarding the associated station (containing the phase data regarding the latent image carrier gear 55). Mounting of the stations to the main housing 2 makes it possible to transfer information between the memories 61Y, 61M, 61C and 61K and the CPU 521. The memories 61Y, 61M, 61C and 61K and the CPU 521 may be electrically connected with each other wireless or through physical contacts. This similarly applies to electric connection between the CPU 521 and the exposure controller 513 and that between the CPU 521 and each cartridge body 32.

Further, as described above, the phase measuring section 522 is electrically connected with the respective phase sensors 57 (57Y, 57M, 57C and 57K) and can therefore receive detection signals which the respective phase sensors 57 output. The phase measuring section 522 is electrically connected further with the mark detection sensor 18 and can therefore receive a detection signal which the mark detection sensor 18 outputs. The phase measuring section 522 detects the phase data (the amplitude and the phase angle) regarding the eccentricity of the latent image carrier gears 55 based on the output signals from the two types of sensors, and outputs the same to the CPU 521. In this embodiment, the phase measuring section 522 thus functions as the "phase detector" of the invention.

The non-volatile memory 523 stores control data which are for control of the engine section EG, and temporarily stores calculation results yielded by the CPU 521 and other data. As one of the contents to store, the memory 523 stores, as a correction table, correction data which are for periodic correction of the synchronization signal Hsync in correlation with the latent image carrier gears 55, and the memory 523 functions as the "memory" of the invention. That is, as shown in FIG. 11, the memory 523 stores correction values (the amplitudes and the phase angles) which are determined by the amplitudes and the phase angles constituting the phase data, in the format of a data table. Each correction value (the amplitude and the phase angle) is indicative of the cycle of the synchronization signal Hsync which is output as each photosensitive member drum 20 rotates one round. For instance, a correction value (40, 210) may be set as the correction data as that shown in FIG. 12. This adjusts the locations on the photosensitive member drums (latent image carriers) 20 at which latent images are written, and improves an image quality. Operations in the image forming apparatus shown in FIG. 6 will now be described with reference to FIG. 13.

Figure 13:
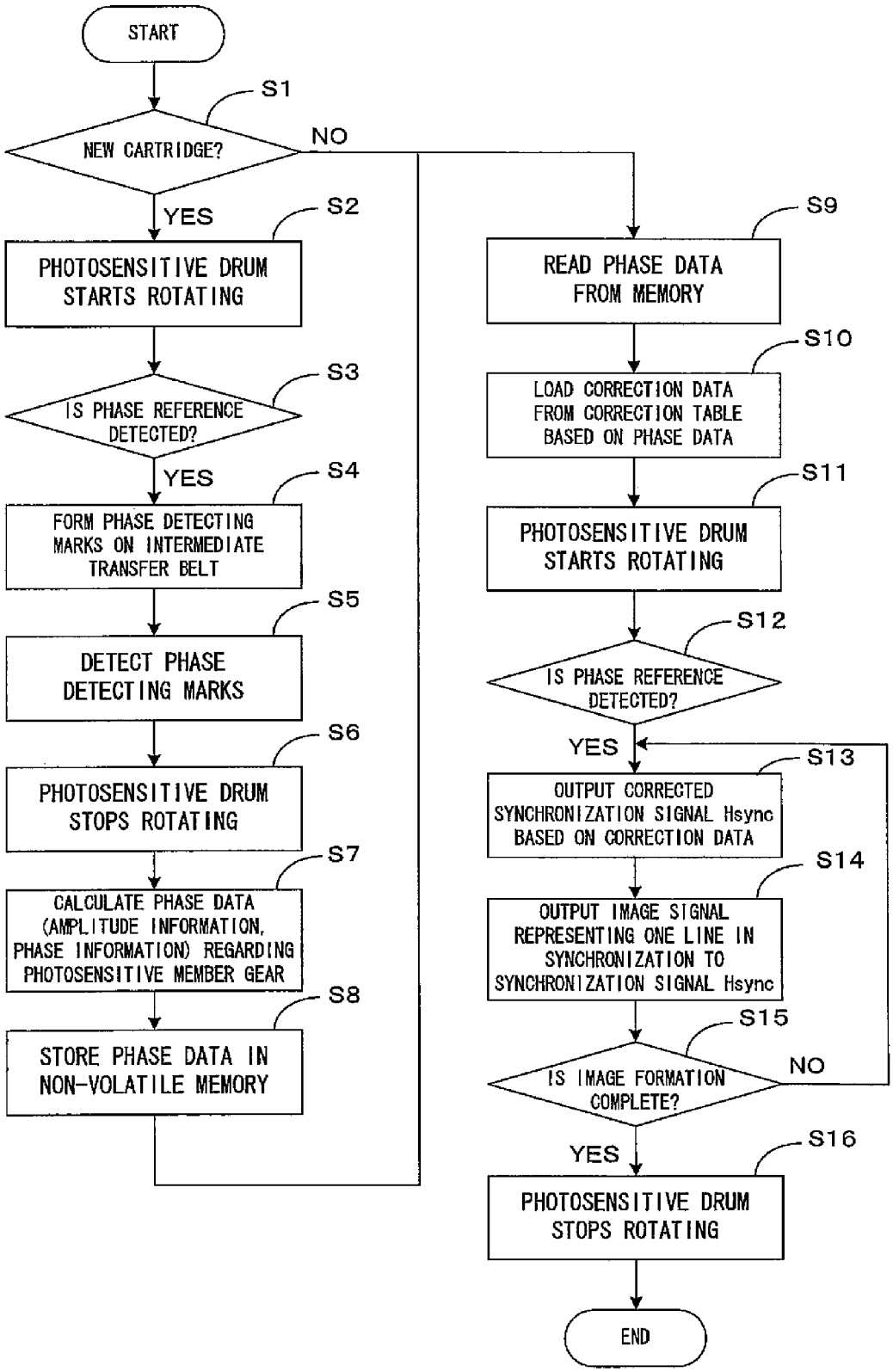
FIG. 13 is a flow chart which shows an operation of adjusting the locations on the photosensitive member drums at which latent images are written.

FIG. 13 is a flow chart which shows an operation of adjusting the locations on the photosensitive member drums at which latent images are written. In this embodiment, as an image forming command (print command) is fed to the main controller 51 from an external apparatus such as a host computer, correction data are loaded in. The data loading is executed based on the phase data regarding the latent image carrier gears 55 for the respective toner colors, before forming images. An image signal is fed to the line heads 231 in synchronization to the synchronization signal which is periodically output based on the correction data, whereby images are formed. Hence, it is necessary to set the phase data regarding the latent image carrier gears 55 in advance for the respective image forming stations Y, M, C and K mounted to the main housing 2. Noting this, this embodiment requires determining whether the stations are new cartridges (Step S1). When they are new cartridges, phase data calculation which will be described below is executed. That is, the phase data regarding the latent image carrier gears 55 disposed to the image forming stations are calculated and stored in the non-volatile memories 61 (Step S2-Step S8). As for the stations on which phase data have already been calculated, the sequence proceeds to Step S9 without this phase data calculation.

At Step S2 of the phase data calculation, the motor for the image forming station determined as a new cartridge is driven, which initiates rotations of the photosensitive member drum 20 which forms this station. For instance, the drive motor 50K activates when it is determined that the black station K is a new cartridge, while when it is determined that the yellow, magenta or cyan station Y, M or C is a new cartridge, the drive motor 50CL activates. Step S2-Step S8 are executed on those stations for which phase data need be yielded.

Once the photosensitive member drum 20 starts rotating, the phase detecting projection 56 disposed to the photosensitive member gear 55 moves passed the phase sensor 57, and a pulse signal is output to the phase measuring section 522. The phase detecting projection 56 serving as a phase reference is thus detected (Step S3), and phase detecting marks are formed (Step S4). In this embodiment, like the phase detecting marks described in the section "A. INFLUENCE OF ECCENTRIC LATENT IMAGE CARRIER GEARS AND COUNTERMEASURES" 27 phase detecting marks MK(1) through MK(27) are formed on the intermediate transfer belt 16 (FIG. 1). Every time the phase detecting marks MK(1), MK(2), . . . move passed the mark detection sensor 18, the mark detection sensor 18 outputs a mark detection signal to the phase measuring section 522. In this manner, the phase detecting marks MK(1) through MK(27) formed along the circumferential length of the photosensitive member drum 20 are detected, concurrently with which the photosensitive member drum 20 stops rotating (Step S6). Although the marks are the same as those marks described earlier under the section "A. INFLUENCE OF ECCENTRIC LATENT IMAGE CARRIER GEARS AND COUNTERMEASURES", the number, the shape and the like of the marks may be determined freely.

At Step S7 which follows, the phase measuring section 522 calculates the phase data regarding the latent image carrier gears 55 based on the detection signal described above. Describing in more specific details, location errors (=the ideal locations−the actually measured locations) are calculated as for the marks MK(2) through MK(27) in a similar manner to that described in the section "A. INFLUENCE OF ECCENTRIC LATENT IMAGE CARRIER GEARS AND COUNTERMEASURES". These location errors are correlated with the distances from the mark MK(1) on the intermediate transfer belt 16, and the eccentricity-related characteristics of the latent image carrier gears 55 similar to that illustrated in FIG. 2 are identified. Thus calculated phase data (the amplitude and the phase angle) are written and stored in the non-volatile memories 61 of the image forming stations for which the phase data calculation is performed (Step S8). The phase data are stored temporarily in the memory 523 of the engine controller 52 as well, for the purpose of forming images.

In this embodiment, when the phase data regarding the latent image carrier gear 55 are unknown due to the fact that the latent image carrier gear 55 belongs to a new cartridge, the phase, detecting marks MK(1) through MK(27) are formed which will then be read for calculation of the phase data regarding the latent image carrier gear 55. This makes it possible to identify and the eccentricity-related characteristic of the latent image carrier gear 55 without fail. Further, since thus calculated phase data are stored in the non-volatile memory 61 attached to the associated cartridge body 32, the phase data calculation (Step S2-Step S8) described above will not be necessary any more after the storage. Of course, in the event as well that this image forming station needs be remounted to the same apparatus or mounted to other apparatus after detached from the main housing 2, the sequence may proceed to Step S9 without execution of the phase data calculation.

Upon completion of the phase data calculation or when the decision at Step S1 is "NO", the sequence proceeds to Step S9 at which the phase data are read out from the memory 61 of each image forming station. As described above, the phase data contain the amplitude information and the phase information (phase angle) which specify the eccentricity-related characteristic of the latent image carrier gears 55. Noting this, this embodiment requires retrieving as the correction data a correction value (the amplitude and the phase angle) which is determined by the phase data, from the correction table in which the phase data are correlated with the correction data which are for suppressing the eccentricity-induced influence (Step S10). The correction data are indicative of the cycles of the synchronization signal Hsync which is output as each photosensitive member drum 20 rotates one round. When the amplitude and the phase angle constituting the phase data are respectively "40" and "210" for example, the correction data shown in FIG. 12 are loaded.

At Step S11 which follows, all motors 50K and 50CL are driven, which starts rotating all photosensitive member drums 20. In each station, after detection of the phase defecting projection 56 serving as a phase reference (Step S12), the CPU 521 outputs to the exposure controller 513 the synchronization signal Hsync whose cycles have been corrected based on the correction data loaded at Step S10 (Step S13). The exposure controller 513 then outputs to the line head 231 the image signal VSG which represents one line in synchronization to the synchronization signal Hsync whose cycles have been corrected (Step S14). Meanwhile, receiving the image signal VSG which represents one line, the line head 231 outputs a signal indicative of this to the CPU 521. It is thus confirmed that the line head 231 now holds the image signal which represents one line. In response, the CPU 521 outputs the strobe signal STB to the image writer 23, and the light emitting elements 232 corresponding to the image signal VSG described above simultaneously emit light and turn off after a certain period of time. Therefore, a line latent image is formed on the photosensitive member drum 20. This line latent image formation (Step S13, Step S14) is repeated until it is determined at Step S15 that image formation has finished. In this manner, in the respective image forming stations, two-dimensional latent images are formed on the photosensitive member drums 20 and developed, and toner images are consequently formed and superimposed one atop the other on the intermediate transfer belt 16, thereby forming a color image. When it is determined at Step S15 that image formation has ended, all photosensitive member drums 20 stop rotating (Step S16).

As described above, in this embodiment, the cycles of the synchronization signal Hsync are corrected in accordance with the eccentricity of the latent image carrier gears 55 and the locations on the photosensitive member drums 20 at which latent images are written are adjusted. This correction makes it to possible to suppress the eccentricity-induced influence and to improve an image quality. Correction of the cycles of the synchronization signal Hsync is remarkably advantageous in further improving an image quality in the case of an apparatus in which the latent image carrier gears 55 and the photosensitive member drums 20 are integrated with each other. In short, in a tandem-type apparatus which uses image forming stations in which the latent image carrier gears 55 and the photosensitive member drums 20 are integrated with each other, the eccentricity-related characteristic of one latent image carrier gear 55 may sometimes be different from that of another latent image carrier gear 55. Therefore, even application of the invention described in JP-A-6-177431 may not lead to an improved image quality. In contrast, the embodiment above requires correction based on the phase data regarding the latent image carrier gear 55 for each photosensitive member drum 20. Hence, even in an apparatus wherein the eccentricity-related characteristic varies between the latent image carrier gears 55 of the respective stations, it is possible to suppress the influence exerted by the eccentricity of the latent image carrier gears 55 without fail.

The phase data regarding the latent image carrier gears 55 may be measured prior to mounting of new cartridges to the apparatus 1 and stored in the non-volatile memories 61. In this case the phase data calculation (Step S2-Step S8) is not necessary. However, for advance measurement of the phase data on the cartridges (image forming stations) themselves, it is necessary to use a dedicated measuring apparatus, which is not efficient in terms of both cost and operability. In contrast, since the phase data calculation (Step S2-Step S8) is executed on new cartridges and the phase data are automatically calculated within the apparatus according to the embodiment described above, it is possible to omit such advance measurement and therefore efficiently and accurately calculate the phase data.

Further, the embodiment described above requires that the amplitude information and the phase information (phase angle) constitute the phase data and that the phase data are correlated with the correction data which are for suppressing the eccentricity-induced influence and stored in the correction table. It further requires retrieving the correction data corresponding to the phase data obtained in the fashion described above, namely, a correction value (the amplitude and the phase angle). It is thus possible to obtain the correction data without following the same procedure as that described in the section "A. INFLUENCE OF ECCENTRIC LATENT IMAGE CARRIER GEARS AND COUNTERMEASURES", shorten the time necessary for image formation, and simplify the control.

In addition, since light emission from the light emitting elements 232 is controlled using the strobe signal STB in the embodiment described above, it is possible to form an image of high quality. That is, even when the cycles of the synchronization signal Hsync are corrected and the locations at which latent images are written are adjusted as described above, the light emission period remains approximately the same between line latent images. As a result, it is possible to prevent density variations attributable to uneven light emission periods without fail and therefore form an image having a superior quality.

C. Second Embodiment

The first embodiment described above requires controlling the cycles of the synchronization signal Hsync to thereby adjust the locations at which latent images are written. The write locations may be adjusted through control of the cycles of the strobe signal STB instead of control of the cycles of the synchronization signal Hsync. This is because the line heads 231 having the structure described above turn on the light emitting elements 232 in accordance with the strobe signal STB. The second embodiment will now be described with reference to FIG. 14. The structure of the apparatus, the phase data calculation and the like are the same as those according to the first embodiment, and therefore, differences will be described mainly.

Figure 14:
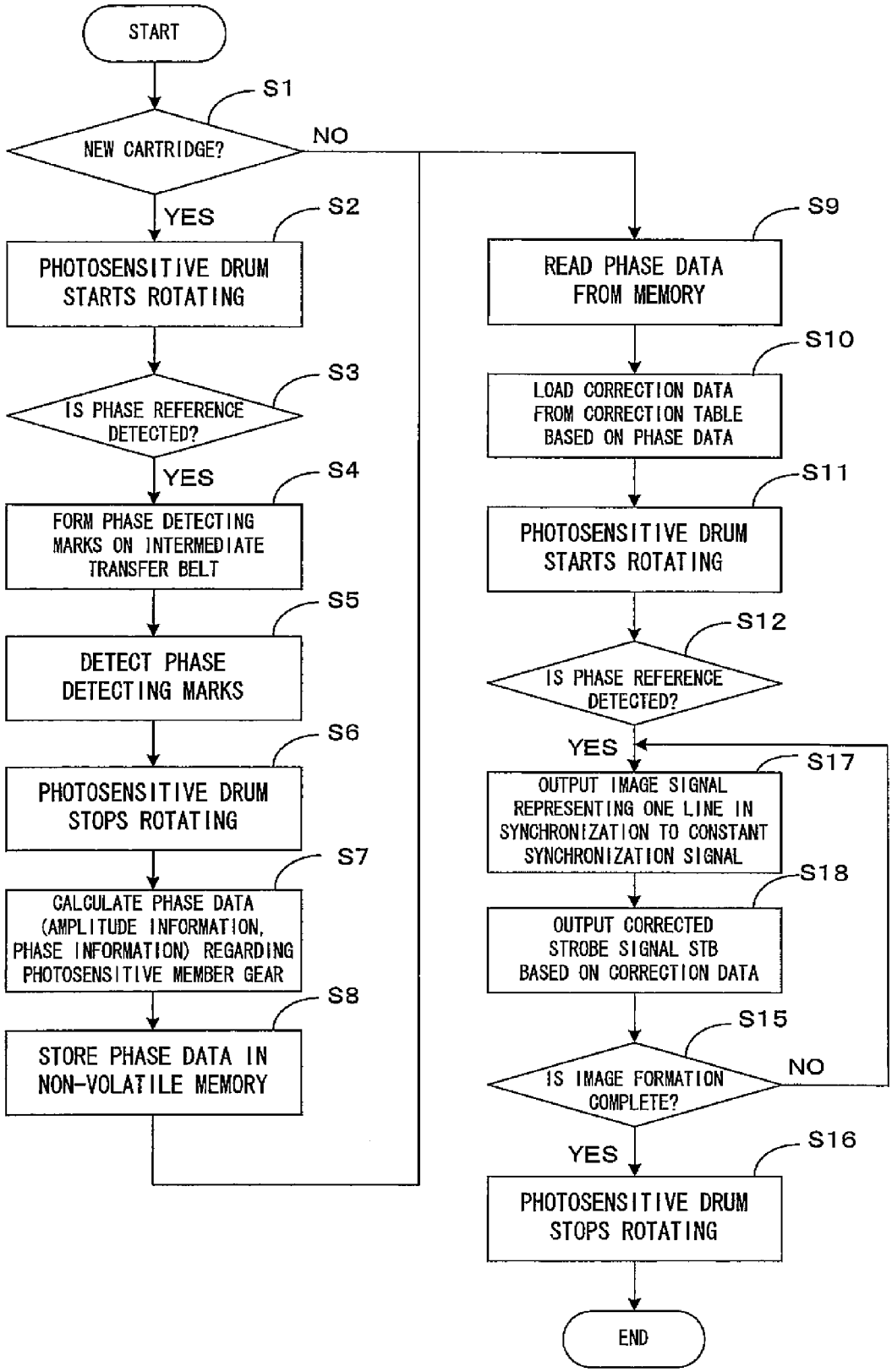
FIG. 14 is a flow chart which shows an operation of adjusting the locations at which latent images are written according to the second embodiment.

FIG. 14 is a flow chart which shows an operation of adjusting the locations at which latent images are written according to the second embodiment. In the second embodiment as well, the phase data regarding the latent image carrier gears 55 are obtained through execution of the phase data calculation (Step S2-Step S8) on new cartridges, which is similar to the first embodiment. At Step S9, the phase data are read out from the memory 61 of each image forming station. The phase data contain the amplitude information and the phase information (phase angle) which specify the eccentricity-related characteristic of the latent image carrier gears 55.

Noting this, this embodiment requires retrieving as the correction data a correction value (the amplitude and the phase angle) which is determined by the phase data, from the correction table in which the phase data are correlated with the correction data which are for suppressing the eccentricity-induced influence (Step S10). In the second embodiment however, values obtained by correcting the cycles of the strobe signal STB are stored as the correction data in the correction table. Hence, the timing that the light emitting elements 232 emit light after the line heads have received the image signal VSG which represents one line is changed in accordance with the correction data, which adjusts the write locations of latent images.

At Step S11 which follows, all motors 50K and 50CL are driven, which starts rotating all photosensitive member drums 20. In each station, after detection of the phase detecting projection 56 serving as a phase reference (Step S12), the CPU 521 of the engine controller 52 outputs to the exposure controller 513 the synchronization signal Hsync in constant cycles. The exposure controller 513 then outputs to the line head 231 the image signal VSG which represents one line in synchronization to the synchronization signal Hsync (Step S17). Meanwhile, receiving the image signal VSG which represents one line, the line head 231 outputs a signal indicative of this to the CPU 521. In the second embodiment however, the CPU 521 does not output the strobe signal immediately. The CPU 521 outputs the strobe signal STB to the image writer 23 only after the corrected cycles start (Step S18). The light emitting elements 232 emit light in accordance with the image signal in the cycles which are expressed by the correction data and turn off after a certain period of time, whereby a line latent image is formed on the photosensitive member drum 20. This line latent image formation (Step S17, Step S18) is repeated until it is determined at Step S15 that image formation has finished. In this manner, in the respective image forming stations, two-dimensional latent images are formed on the photosensitive member drums 20 and developed, and toner images are consequently formed and superimposed one atop the other on the intermediate transfer belt 16, thereby forming a color image. When it is determined at Step S15 that image formation has ended, all photosensitive member drums 20 stop rotating (Step S16).

As described above, the second embodiment as well realizes similar effects to those according to the first embodiment. That is, the locations on the photosensitive member drums 20 at which latent images are written are adjusted as the cycles of the strobe signal STB are corrected in accordance with the eccentricity of the latent image carrier gears 55. Hence, it is possible to suppress the influence exerted by the eccentricity and improve an image quality. The other effects are also similar.

In the first embodiment, with arrival of the image signal VSG which represents one line at the line head 231, the CPU 521 receives a signal indicative of this and confirms that the line head 231 now holds the image signal which represents one line. Means which confirms holding of one line is not limited to this. For instance, upon outputting of the image signal VSG which represents one line from the exposure controller 513, the CPU 521 may receive a signal indicative of this and confirm that the line head 231 now holds the image signal which represents one line.

Further, write locations are adjusted through control of the timing of outputting the image signal VSG to the line head 231 in the first embodiment. The second embodiment achieves adjustment of write locations through control of the timing at which the light emitting elements 232 emit light in the second embodiment. The output timing and the light emission timing are closely related to each other. For instance, even despite control of the output timing, if the strobe signal STB is output before transmission of the image signal representing one line to the line head 231 completes, a problem arises that an image gets partially lacked. To securely prevent this problem, the output timing and the light emission timing are both preferably correlated with the phase data regarding the latent image carrier gears 55 and controlled.

Further, the embodiments above require that the phase data calculation (Step S2-Step S8) is executed and the phase measuring section 522 detects the phase data. The phase data regarding the latent image carrier gears 55 of all cartridges may be measured in advance and read from the non-volatile memories 61 for detection of the phase data. In such case the CPU 521 which reads the phase data from the memories 61 corresponds to the "phase detector" of the invention.

D. Third Embodiment

Although the image Writers 23 are formed by the LED line heads 231 in the first and the second embodiments described above, the structure of the image writers 23 is not limited to this. For example, an alternative may be a line head in which multiple organic EL (electroluminescence) elements are arranged in rows along the axial direction of the photosensitive member drums 20 (the direction which is perpendicular to the plane of FIG. 6). However, since simultaneous light emission from an organic EL line head is impossible, an apparatus which uses organic EL line heads is partially different from an apparatus which uses the LED line heads 231. The third embodiment will now be described, with a focus on the difference.

Figure 15:
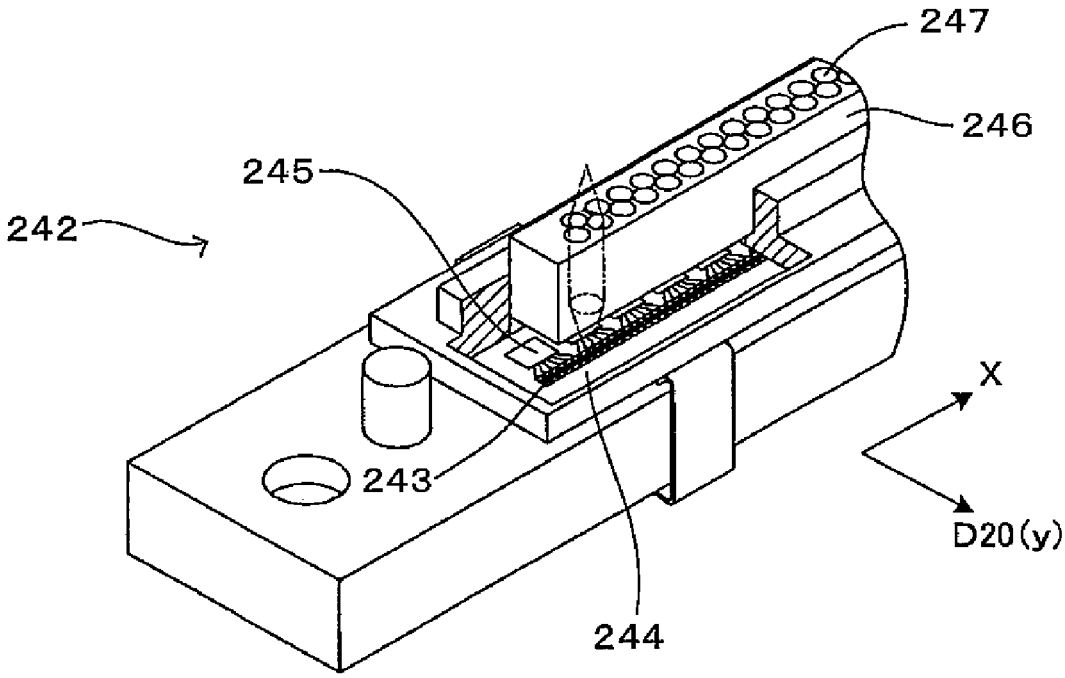
FIG. 15 is a schematic perspective view of a line head which uses organic EL elements.

FIG. 15 is a schematic perspective view of a line head which uses organic EL elements. In FIG. 15, the details disposed in the image writers 23 are shown. In a line head 242 of each image writer 23, multiple organic EL elements 243 are held within an elongated housing as they are arranged in rows (in a two-row staggered pattern) along the main scanning direction X. In this image writer 23, a light emitter including element rows formed by the organic EL elements 243 are mounted on a glass substrate 244, and the organic EL elements are driven by TFTs (Thin Film Transistors) 245 which are formed on the same glass substrate 244. In short, when the exposure controller 513 receives an image signal, the TFTs 245 activate based on the image signal and the organic EL elements 243 emit light one after another. A gradient index rod lens array 246 forms an imaging optical system, in which the gradient index rod lenses 247 located in the front face of the light emitter are piled up like bricks. The housing is disposed surrounding the glass substrate 244 but remains open on its side which is opposed against the photosensitive member drum 20. Rays are thus emitted from the gradient index rod lenses 247 to the photosensitive member drum 20. In consequence, a latent image corresponding to the image signal is formed on the photosensitive member drum 20. Hence, control of the timing at which the exposure controller 513 outputs the image signal VSG makes it possible to adjust the write location of the latent image. In this embodiment as well, the CPU 521 thus functions as the "timing controller" of the invention.

Figure 16:
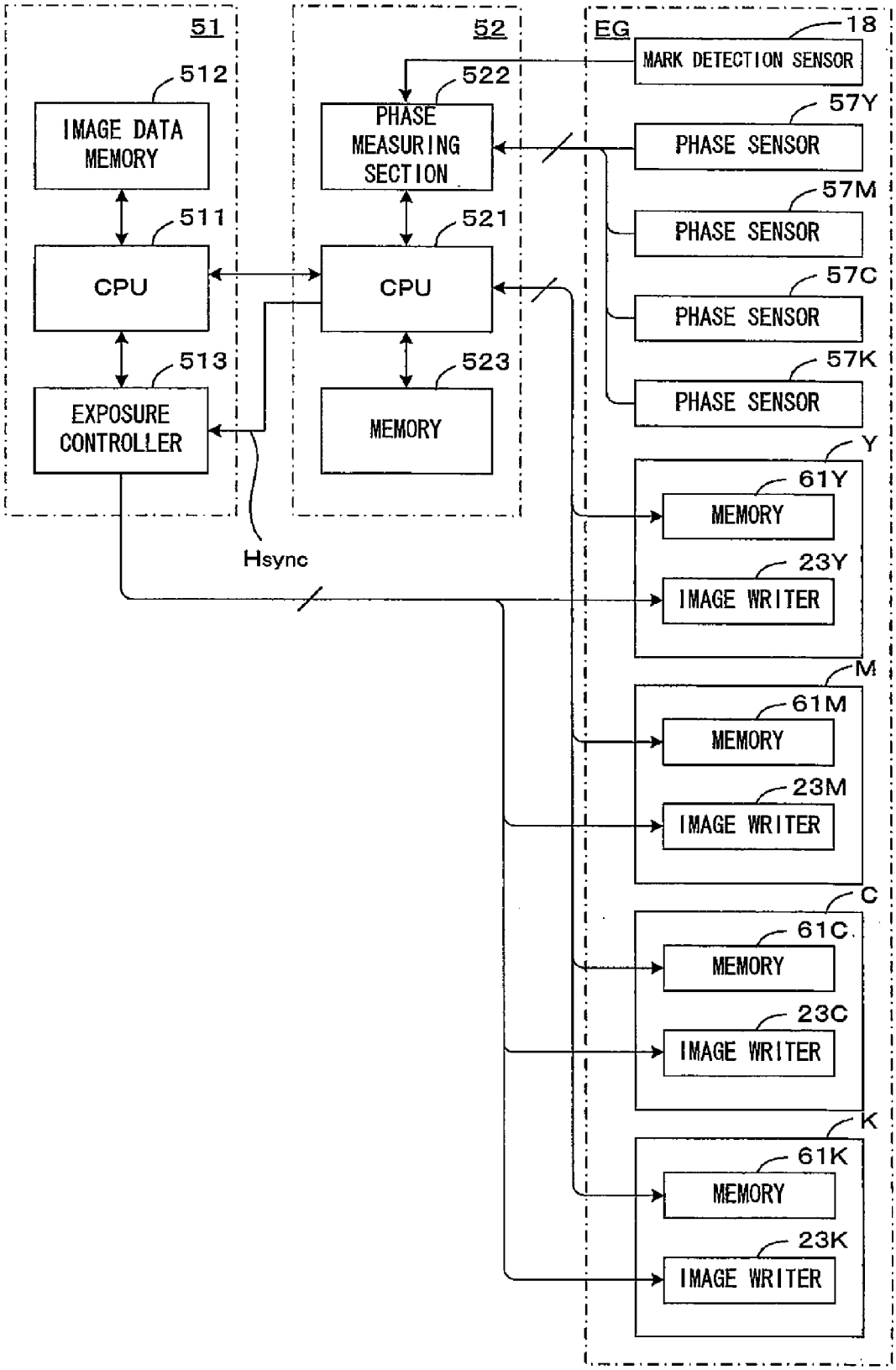
FIG. 16 is a block diagram which shows a principal electric structure in the third embodiment.

FIG. 16 is a block diagram which shows a principal electric structure in the third embodiment. The line heads 242 formed by the organic EL elements do not use a strobe signal as described above. A difference in electric structure of the third embodiment from the first embodiment is only the omission of the strobe signal. The other aspects regarding the electric structure therefore will not be described.

A description will now be given on how the image forming apparatus having the structure above adjusts the write locations of latent images on the photosensitive member drums. In this embodiment, upon receipt of an image forming command print command) at the main controller 51 from an external apparatus such as a host computer, whether the respective image forming stations Y, M, C and K are new cartridges is determined. When they are new cartridges, the phase data calculation is executed in a similar manner to that according to the first embodiment. In other words, the phase data regarding the latent image carrier gears 55 disposed to the stations are calculated and stored in the non-volatile memories 61, and as for the stations, the correction data are then loaded based on the phase data regarding the latent image carrier gears 55. With respect to the station if any on which phase data have already been calculated, the correction data are loaded based on the phase data regarding the corresponding latent image carrier gear 55 without executing the phase data calculation. Following this, in synchronization to the synchronization signal, the image signal is fed to the line heads 242, thereby forming images. The synchronization signal is output in the cycles which are based on the corrected data. That is, the image formation is performed in the following manner.

The phase data are read from the memory 61 of each image forming station. The phase data contain the amplitude information and the phase information (phase angle) as described before, and these specify the eccentricity-related characteristic of the latent image carrier gears 55. Noting this, this embodiment as well like the first embodiment requires retrieving a correction value (the amplitude and the phase angle) as the correction data from the correction table. That is, in the correction table the phase data are correlated with the correction data which are for suppressing the eccentricity-induced influence. When the phase data is read, the correction data is determined based on the phase data and the correction table. This correction data are indicative of the cycles of the synchronization signal Hsync which is output as each photosensitive member drum 20 rotates one round. When the amplitude and the phase angle constituting the phase data are respectively "40" and "210" for example, the correction data shown in FIG. 12 are loaded.

Next, all motors 50K and 50CL are driven, which starts rotating all photosensitive member drums 20. In each station, after detection of the phase detecting projection 56 serving as a phase reference, the CPU 521 outputs to the exposure controller 513 the synchronization signal Hsync whose cycles have been corrected based on thus loaded correction data. The exposure controller 513 then outputs the image signal VSG to the line head 242 in synchronization to the synchronization signal Hsync whose cycles have already been corrected. In the line head 242, in accordance with the serially fed image signal VSG, the organic EL elements 243 emit light one after another, starting with the far-most one located at one end, whereby a line latent image is formed on the photosensitive member drum 20. This line latent image formation is repeated until it is determined that image formation has finished. In this manner, in the respective image forming stations, two-dimensional latent images are formed on the photosensitive member drums 20 and developed, and toner images are consequently formed and superimposed one atop the other on the intermediate transfer belt 16, thereby forming a color image. When it is determined that image formation has ended, all photosensitive member drums 20 stop rotating.

As described above, according to the third embodiment, the cycles of the synchronization signal Hsync are corrected in light of the eccentricity of the photosensitive member gears 55, the write locations of line latent images on the photosensitive member drums 20 are consequently adjusted, thereby improving an image quality. Correction of the cycles of the synchronization signal Hsync is remarkably advantageous in further improving an image quality in the case of an apparatus in which the photosensitive member gears 55 and the photosensitive member drums 20 are integrated with each other. In short, in a tandem-type apparatus which uses image forming stations in which the photosensitive member gears 55 and the photosensitive member drums 20 are integrated with each other, the eccentricity-related characteristic of one photosensitive member gear 55 may sometimes be different from that of another photosensitive member gear 55. Therefore, even adjustment of the relationship between the photosensitive member drums 20 in terms of rotation phase may not make it possible to improve an image quality. On the contrary, this embodiment demands correction based on the phase data regarding the corresponding latent image carrier gear 55 for each photosensitive member drum 20. Hence, even in an apparatus wherein the eccentricity-related characteristics of the photosensitive member gears 55 are different between the respective stations, it is possible to suppress the influence due to the eccentricity of the photosensitive member gears 55 without fail.

The phase data regarding the corresponding latent image carrier gears 55 may be measured before mounting new cartridges to the apparatus 1 and stored in the non-volatile memories 61. In such case the phase data calculation is not necessary. However, for advance measurement of the phase data on the cartridges (image forming stations) themselves, it is necessary to use a dedicated measuring apparatus, which is not efficient in terms of both cost and operability. In contrast, since the phase data calculation is executed on new cartridges and the phase data are automatically calculated within the apparatus according to the embodiment described above, it is possible to omit such advance measurement and therefore efficiently and accurately calculate the phase data.

According to the embodiment above, the amplitude information and the phase information (phase angle) constitute the phase data. Furthermore, the phase data are correlated with the correction data which are for suppressing the eccentricity-induced influence and stored in the correction table. The correction data corresponding to thus identify phase data, namely, a correction value (the amplitude and the phase angle) is retrieved. It is thus possible to obtain the correction without following the same procedure as that described in the section "A. INFLUENCE OF ECCENTRIC LATENT AGE CARRIER GEARS AND COUNTERMEASURES", shorten the time necessary for image formation, and simplify the control.

E. Fourth Embodiment

By the way, while the third embodiment described above uses the line heads 242 in which the multiple organic EL elements 243 are arranged in rows (in a two-row staggered pattern) along the main scanning direction X, the structure of the line heads is not limited to this. The invention is applicable also to an image forming apparatus which comprises line heads of the multiple exposure type shown in FIG. 17 for example, in which case as well similar effects to those according to the third embodiment are obtained.

Figure 17:
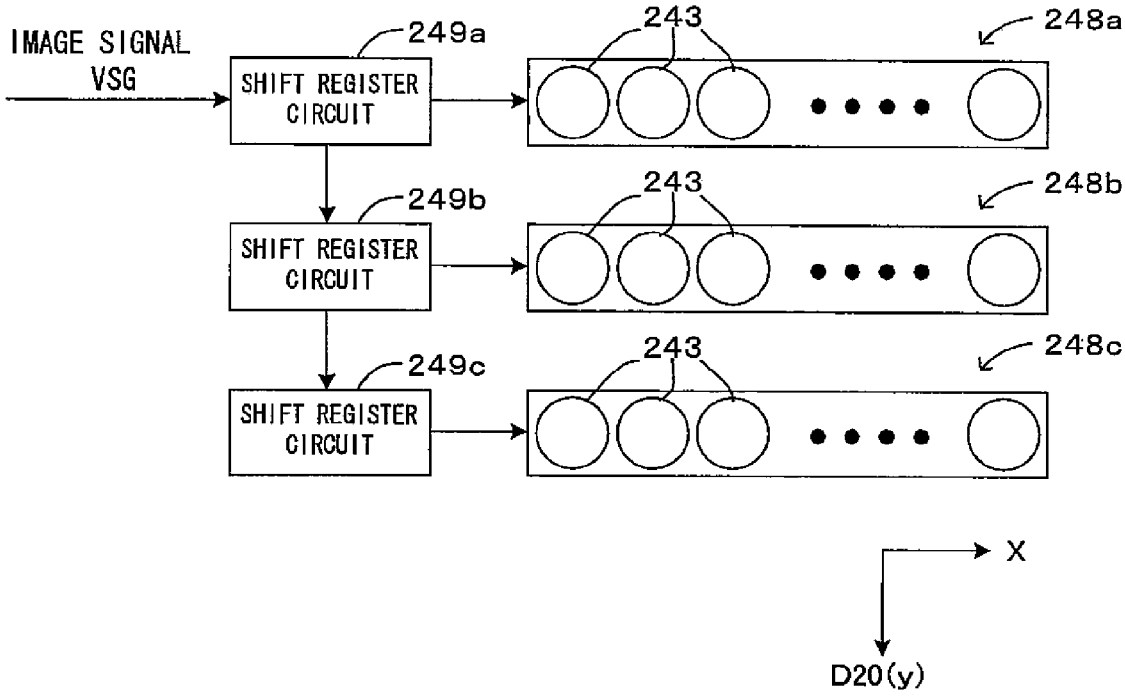
FIG. 17 is a drawing which shows the structure of the line heads according to the fourth embodiment.

FIG. 17 is a drawing which shows the structure of the line heads according to the fourth embodiment. In the line heads 242 according to the fourth embodiment, multiple (three in this embodiment) element rows 248*a* through 248*c* are disposed along the sub scanning direction D20. Each of the element rows 248*a* through 248*c* has the multiple organic EL elements 243 which are arranged in rows (in one linear line) along the main scanning direction X. In other words, the line heads 242 have a two-dimensional arrangement structure. In accordance with the element rows 248*a* through 248*c*, shift register circuits 249*a* through 249*c* are disposed which execute transfer. The circuits 249*a* through 249*c* hold and output to the elements of the image signal VSG output from the exposure controller 513. That is, in this embodiment, the image signal corresponding to the element count N of the organic EL elements 243 forming the element rows is "the image signal representing one line". The exposure controller 51 outputs the image signal VSG representing one line to the shift register circuit 249*a*, in synchronization to the synchronization signal Hsync whose cycles have been corrected. Receiving the image signal VSG, the shift register circuit 249*a* makes the organic EL elements 243 forming the top element row 248*a* emit light, whereby the pixels on the photosensitive member drum 20 are exposed with a predetermined amount of light.

Further, as the photosensitive member drum 20 moves along the sub scanning direction D20, the pixels exposed by the organic EL elements of the top element row 248*a* move to positions opposed against the next element row 248*b*. At this timing, the image signal VSG fed to the shift register circuit 249*a* is passed on to the shift register circuit 249*b*. The shift register circuit 249*b* outputs the image signal VSG to the central element row 248*b* and makes the organic EL elements 243 emit light. Hence, the pixels exposed by the organic EL elements of the top element row 248*a* get exposed again with the same amount of light. The image signal VSG is transferred among the shift register circuits 249*a* through 249*c* while the photosensitive member drum 20 moves along the sub scanning direction D20, following which the image signal VSG is output to the organic EL elements 243 so that the same pixels are exposed serially by the organic EL elements 243 belonging to a different element row.

Hence, in the embodiment shown in FIG. 17, a pixel is exposed with the amount of light which is three times as large as that for exposure with a single organic EL element, which permits achieving necessary brightness at a high speed. Further, in this embodiment, the exposure controller 513 outputs the image signal VSG in synchronization to the synchronization signal Hsync whose cycles have been corrected and the write timing is accordingly adjusted. Therefore, the locations of latent images written by the top element row 248*a* are at approximately equal pitches from each other along the sub scanning direction D20. Furthermore, in case that the gaps between the element rows 248*a* through 248*c* are aligned to these pitches, the following effect is obtained. That is, even despite the periodicity of the rotation speed of the photosensitive member drum 20 attributable to the eccentricity of the photosensitive member gear 55, it is possible to highly accurately superimpose the pixels exposed by the respective element rows 248*a* through 248*c* one atop the other and therefore to improve an image quality. As described above, in this embodiment, the exposure controller 513 outputs the one line image signal VSG which corresponds to the element count N of the organic EL elements 243 ($N \geqq 2$) forming each element row and represents one line. On the basis of the signal VSG, the element rows form line latent images at the same locations yet at different timing in the order of their arrangement along the sub scanning direction D20. The multiple exposure is executed. The effects described above are obtained through execution of multiple exposure in which the exposure timing is adjusted in accordance with the corrected cycles of the synchronization signal Hsync.

F. Fifth Embodiment

By the way, in the embodiments above, the phase data calculation is always executed when it is determined that an image forming station mounted to the main housing 2 is a new cartridge. However, gears are not made one at a time but manufactured in industrial production units each of which contains a certain quantity. Therefore, groups of gears manufactured in the same period under constant conditions have the same or similar eccentricity-related characteristics. Considering this, execution of processing for uniformly identifying the eccentricity-related characteristics of the respective latent image carrier gears whose eccentricity-related characteristics are the same or similar, is not efficient. On the other hand, if images are formed without precisely grasping the eccentricity-related characteristics of the latent image carrier gears, the aforementioned problem will occur. In light of this, according to the invention, even when some stations are new cartridges, the phase data calculation described above is omitted on those new cartridges which use the photosensitive member gears 55 whose eccentricity-related characteristics are equal. This feature of the invention will now be described in details with reference to FIGS. 18 through 20.

Figure 18:
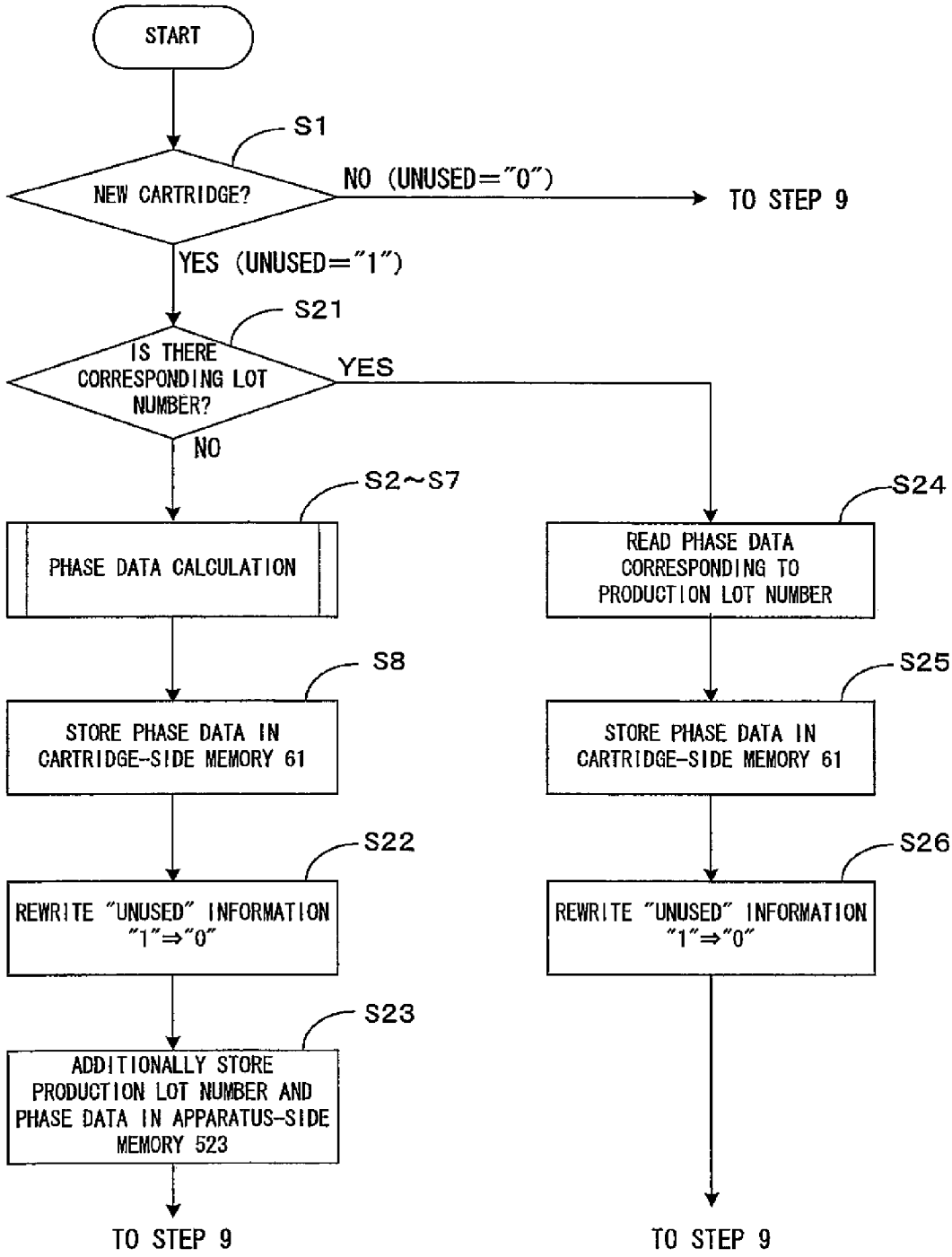
FIG. 18 is a flow chart which shows a method of detecting the eccentricity of a gear according to the invention.
Figure 19:
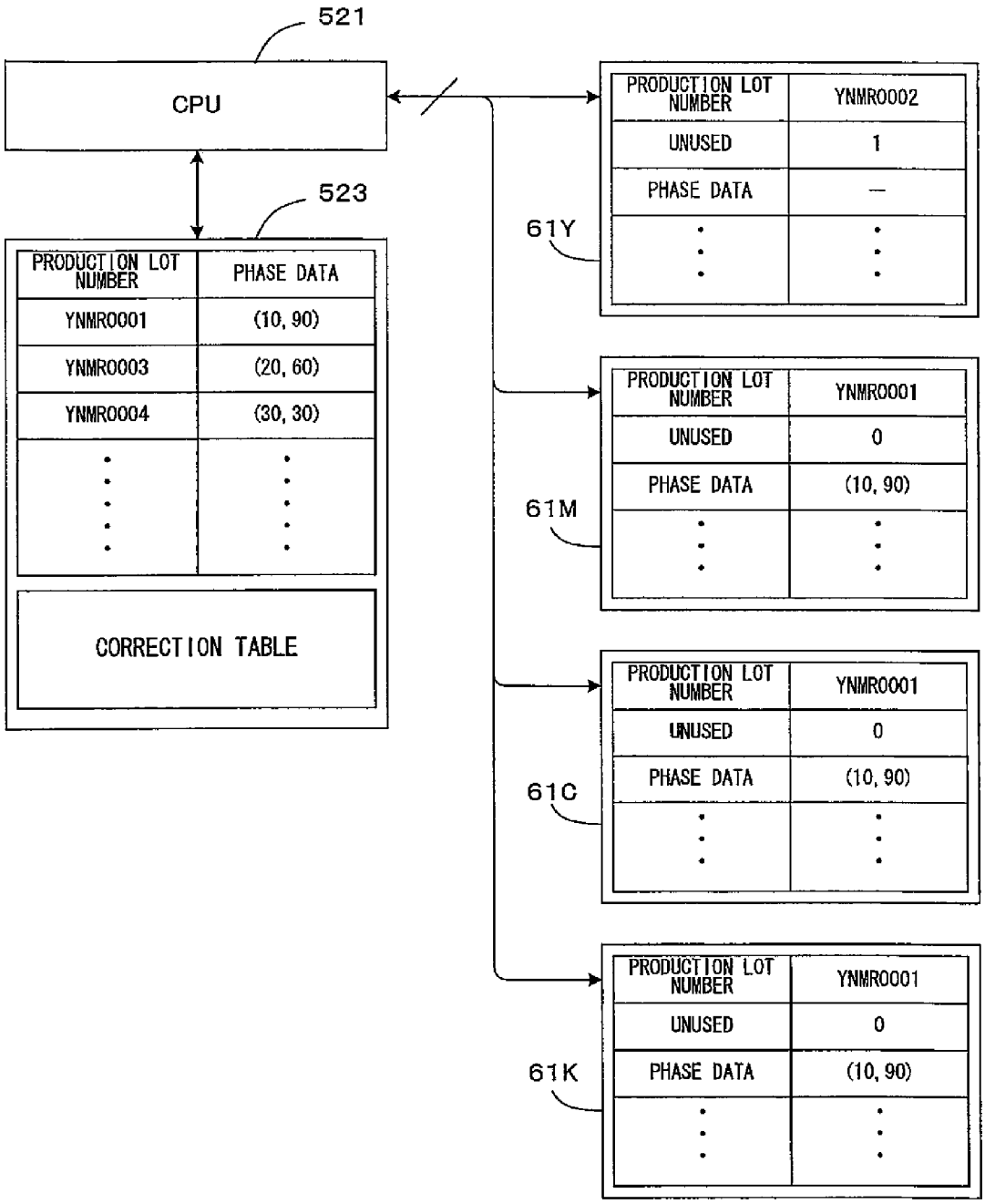
FIGS. 19 and 20 are drawings which shows one example of information which is stored in the memories disposed to the image forming apparatus.
Figure 20:
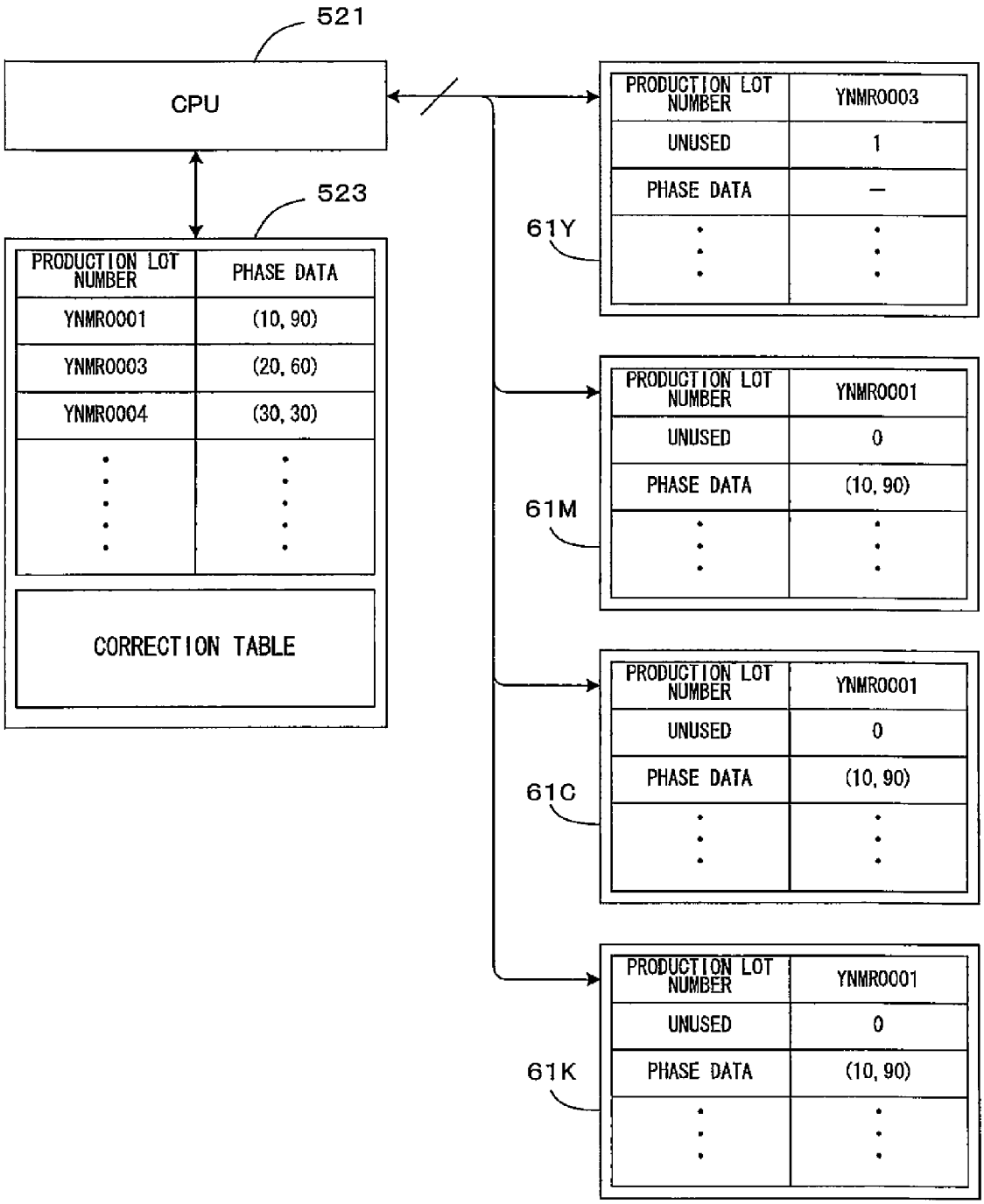

FIG. 18 is a flow chart which shows a method of detecting the eccentricity of a gear according to the invention. FIGS. 19 and 20 are drawings which shows one example of information which is stored in the memories disposed to the image forming apparatus according to the invention. One of major differences of this embodiment from the apparatuses described above lies in the memory structure. That is, as shown in FIGS. 19 and 20, the memory 523 of the engine controller 52 stores a phase data table in which PRODUCTION LOT NUMBER and PHASE DATA of the photosensitive member gears 55 of the photosensitive member on which phase data have already been calculated. Meanwhile, each one of the memories 61Y, 61M, 61C and 61K of the cartridges is capable of storing PRODUCTION LOT NUMBER in addition to UNUSED and PHASE DATA. Of these pieces of information, UNUSED is indicative of whether this image forming station is a new cartridge, and when the cartridge has not been used yet, "1" is stored, whereas "0" is stored once use of the cartridge starts. Further, PHASE DATA contains the phase data which are constituted by the amplitude information and the phase information (phase angle) which express the eccentricity-related characteristic of the photosensitive member gear 55. PRODUCTION LOT NUMBER additionally stored according to this embodiment is the production lot number assigned to the photosensitive member gear 55 attached to the cartridge body 32. When gears whose specifications are the same are manufactured in a lot, the production lot number is commonly assigned to those manufactured gears, and therefore, the characteristics of the group of gears bearing the same production lot number are the same or similar, including the eccentricity-related characteristics. In this embodiment, the production lot number is thus used as the "gear information" of the invention.

Operations in the image forming apparatus according to the invention will now be described in details. This embodiment is directed to a partial modification of the operations according to the embodiment which is shown in FIG. 13, but the phase data calculation (Step S2 to Step S7), the processing for obtaining correction data and the line latent image formation remain the same. Differences will be mainly described below. For easy understanding of the operations, a specific operation in the apparatus whose memory status is as shown in FIG. 19 or 20 will be described as an example.

Upon receipt of an image forming command (print command) at the main controller 51 from an external apparatus such as a host computer, whether the respective image forming stations are new cartridges is determined (Step S1). In the apparatus whose memory status is as shown in FIG. 19 or 20 for example, the yellow image forming station Y alone is unused, the other image forming stations M, C and K have been used at least once or more times. The phase data regarding the latent image carrier gears 55 are stored also on the cartridge-side memories. Hence, the sequence of operation for the stations other than the yellow station proceeds to Step S9.

On the other hand, the sequence for the yellow image forming station Y determined as a new cartridge proceeds to Step S21. At Step S21, the production lot number stored in the cartridge-side memory 61Y is read, the CPU 521 of the engine controller 52 determines whether this production lot number is stored in the memory 523 of the main apparatus section. In the next breath, phase data are calculated by a different method in accordance with the decision.

For instance, although "YNMR0002" is stored as the production lot number in the apparatus whose memory status is as shown in FIG. 19, this production lot number (gear information) is not stored in the memory 523 of the main apparatus section. In other words, comparison regarding the production lot number tells that the eccentricity-related characteristic of the photosensitive member gear 55 bearing this production lot number is unknown. In response ("NO" at Step S21), the phase data calculation described above (Step S2 to Step S7) is executed, and phase data expressing the eccentricity-related characteristic of the photosensitive member gear 55 bearing this production lot number are consequently calculated. Thus calculated phase data are written and stored in the cartridge-side memory 61Y of the station Y (Step S8), and UNUSED is rewritten to "0" (Step S22). As for the main apparatus section, this phase data and the production lot number are stored as they are correlated to each other within the memory 523 of the engine controller 52 (Step S23). The sequence proceeds to Step S9 once the phase data regarding the new station Y whose eccentricity-related characteristic is unknown have been calculated.

In the apparatus whose memory status is as shown in FIG. 20 for instance, "YNMR0003" is stored as the production lot number, and this production lot number (gear information) is stored in the memory 523 of the main apparatus section and the phase data as well are stored as they are tied to this production lot number. Upon decision of "YES" at Step S21 therefore, the CPU 521 reads the phase data (20, 60) corresponding to the production lot number "YNMR0003" (Step S24). Further, the phase data (20, 60) are written in the cartridge-side memory 61Y of the station Y (Step S25) and UNUSED is rewritten to "0" (Step S26). As for the station Y which is new yet uses the photosensitive member gear 55 bearing the same production lot number, without executing the phase data calculation (S2 to Step S7), the sequence proceeds to Step S9 once the phase data regarding the station Y have been calculated.

Step S9 and the subsequent steps, namely, reading of the phase data (Step S9), retrieving of the correction data (Step S10) and the image formation (Step S11 to Step S16), are similar to those in the embodiments described above.

As described above, according to the embodiment shown in FIG. 18, the production lot numbers and the phase data are stored as they are correlated to each other within the memory 523 of the main apparatus section. Even when a mounted image forming station is a new cartridge, the phase data calculation is skipped as long as the memory 523 of the main apparatus section holds the phase data which correspond to the production lot number of the photosensitive member gear 55. Hence, it is possible to reduce the frequency of execution of the phase data calculation without lowering the accuracy of the phase data, and therefore, to efficiently identify the eccentricity-related characteristics of the photosensitive member gears 55. When a mounted image forming station is a new cartridge and the eccentricity-related characteristic of the associated photosensitive member gear 55 is unknown, the phase data calculation is executed and the phase data regarding the photosensitive member gear 55 are calculated. It is thus possible to precisely identify the eccentricity-related characteristic of this photosensitive member gear 55. Further, since the phase data calculated in this manner are stored in the non-volatile memory 61 attached to the cartridge body 32 of the new cartridge, the phase data calculation (S2 to Step S7) described above will not be necessary any longer. Of course, in the event as well that this image forming station should be reattached to the apparatus after detached from the main housing 2 or attached to a different apparatus, the sequence may proceed to Step S9 without executing the phase data calculation. In addition, the phase data resulting from execution of the phase data calculation are additionally stored, as they are correlated to an unknown production lot number in the memory 523 of the main apparatus section. In consequence, the memory will hold more production lot numbers which are tied to known phase data, which will further reduce the frequency of execution of the phase data calculation.

Although the fifth embodiment require controlling the cycles of the synchronization signal Hsync for adjustment of the locations at which latent images are written, the cycles of the strobe signal STB instead of the synchronization signal Hsync may be controlled for adjustment of the write locations. This is because the line heads 231 having the structure above turn on the light emitting elements 232 in accordance with the strobe signal STB.

Further, in the fifth embodiment, when receiving the image signal VSG representing one line, the line heads 231 outputs the signal indicative of this to the CPU 521 to thereby confirm that the line heads 231 hold the image signal representing one line. The means which confirms holding of one line is not limited to this. For instance, when the exposure controller 513 outputs the image signal VSG representing one line, the exposure controller 513 may output a signal indicative of this to the CPU 521 to thereby confirm that the line heads 231 hold the image signal representing one line.

Further, in the fifth embodiment, the write locations are adjusted by means of control of the timing of outputting the image signal VSG to the line heads 231 or control of the timing of light emission from the light emitting elements 232. The output timing and the light emission timing are closely related to each other. For example, even despite control of the output timing, if the strobe signal STB is output before transmission of the image signal representing one line to the line head 231 completes, a problem arises that an image gets partially lacked. To securely prevent this problem, the output timing and the light emission timing are both preferably correlated with the phase data regarding the latent image carrier gears 55 and controlled.

Further, although the fifth embodiment require that the image writers 23 using the line heads in which light emitting diodes (LEDs) are arranged in rows form line latent images, the structure of the image writers 23 is not limited to this. The line heads may be such line heads in which multiple organic EL (electroluminescence) elements are arranged in rows along the axial direction of the photosensitive member drums 20 (the direction which is perpendicular to the plane of FIG. 6).

Further, in the fifth embodiment, the cycles of the synchronization signal Hsync are corrected in the opposite direction to changes of the pitches between the marks (i.e., the pitch characteristic shown in FIG. 3 for example) as described in the section "A. INFLUENCE OF ECCENTRIC LATENT IMAGE CARRIER GEARS AND COUNTERMASURES". In short, while the correction data are set so that the pitches between the marks MK will be even, the correction data may be set so that the actually measured marks MK shown in FIG. 1 will be located at ideal locations.

Further, the "production lot numbers" are used as the gear information in the fifth embodiment. The gear information is not limited to this but may instead be information which is indicative of that the eccentricity-related characteristics are the same or similar due to commonality with respect to manufacturing, information which is used during classification of the eccentricity-related characteristics as a result of inspection, testing, etc.

G. Others

The invention is not limited to the embodiments described above but may be modified in various manners in addition to the embodiments above, to the extent not deviating from the object of the invention. For instance, the embodiments above require controlling the cycles of the synchronization signal Hsync or the strobe signal STB in the opposite direction to changes of the pitches between the marks (i.e., the pitch characteristic shown in FIG. 3 for example). In short, while the correction data are set so that the pitches between the marks MK will be even, the correction data may be set so that the actually measured marks MK shown in FIG. 1 will be located at ideal locations.

Further, the embodiments described above are directed to the application of the invention to an apparatus which forms a color image using four toner colors of yellow, magenta, cyan and black. The color creation method (tandem, 4-cycle, etc.) and the types and the numbers of the toner colors are not limited to the above. Rather, the invention is generally applicable to any image forming apparatus which forms an image using line heads in which multiple light emitting elements are arranged in rows.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

a latent image carrier which is freely rotatable in a predetermined sub scanning direction;

a latent image carrier gear which is attached to an end portion of the latent image carrier;

a drive motor which applies drive rotation force upon the latent image carrier via the latent image carrier gear and which rotates the latent image carrier;

a line head which forms on the latent image carrier a line latent image which extends in a main scanning direction which is approximately orthogonal to the sub scanning direction;

an exposure controller which provides an image signal to the line head and controls writing of the line latent image;

a phase detector which detects the phase data regarding the latent image carrier gear; and a timing controller which adjusts the write location of the line latent image on the latent image carrier based on the phase data detected by the phase detector, wherein the line head includes multiple light emitting elements which are arranged in rows along the main scanning direction, and every time the line head holds an image signal representing one line corresponding to the multiple light emitting elements from the exposure controller, the multiple light emitting elements are driven approximately simultaneously based on the image signal, the timing controller provides the exposure controller with a synchronization signal, thereby controlling the timing at which the exposure controller outputs the image signal, provides the line head with a strobe signal, thereby controlling the timing at which the multiple light emitting elements emit light, and corrects the cycles of the synchronization signal or the cycles of the strobe signal based on the phase data detected by the phase detector, thereby adjusting the write location of the line latent image on the latent image carrier, and the timing controller corrects the cycles of the strobe signal based on the phase data detected by the phase detector while maintaining the cycles of the synchronization signal to be fed to the exposure controller to constant cycles, thereby adjusting the write location of the line latent image on the latent image carrier.

2. The image forming apparatus of claim 1, further comprising a memory which stores a correction table in which various phase data are correlated to corrected values of the cycles of the strobe signal, wherein the timing controller reads from the correction table a corrected value of the cycles corresponding to the phase data detected by the phase detector, and the multiple light emitting elements emit light in synchronization to the strobe signal whose cycles have thus been corrected.

3. An image forming apparatus comprising:

a latent image carrier which is freely rotatable in a predetermined sub scanning direction;

a latent image carrier gear which is attached to an end portion of the latent image carrier;

a drive motor which applies drive rotation force upon the latent image carrier via the latent image carrier gear and which rotates the latent image carrier;

a line head which forms on the latent image carrier a line latent image which extends in a main scanning direction which is approximately orthogonal to the sub scanning direction;

an exposure controller which provides an image signal to the line head and controls writing of the line latent image;

a phase detector which detects the phase data regarding the latent image carrier gear; and a timing controller which adjusts the write location of the line latent image on the latent image carrier based on the phase data detected by the phase detector, wherein the line head includes multiple light emitting elements which are arranged in rows along the main scanning direction, and every time the line head holds an image signal representing one line corresponding to the multiple light emitting elements from the exposure controller, the multiple light emitting elements are driven approximately simultaneously based on the image signal, the timing controller provides the exposure controller with a synchronization signal, thereby controlling the timing at which the exposure controller outputs the image signal, provides the line head with a strobe signal, thereby controlling the timing at which the multiple light emitting elements emit light, and corrects the cycles of the synchronization signal or the cycles of the strobe signal based on the phase data detected by the phase detector, thereby adjusting the write location of the line latent image on the latent image carrier, and the timing controller corrects the cycles of both the synchronization signal and the strobe signal based on the phase data detected by the phase detector, thereby adjusting the write location of the line latent image on the latent image carrier.

* * * * *